US008993208B2

(12) United States Patent
Matsushima et al.

(10) Patent No.: US 8,993,208 B2
(45) **Date of Patent: *Mar. 31, 2015**

(54) FOIL TRANSFERRING METHOD AND TONER FOR FORMING FOIL TRANSFERRING LAYER

(75) Inventors: Asao Matsushima, Tokyo (JP); Tatsuya Nagase, Tokyo (JP); Yasuko Uchino, Tokyo (JP); Aya Shirai, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 99 days.

This patent is subject to a terminal disclaimer.

(21) Appl. No.: 13/438,925

(22) Filed: Apr. 4, 2012

(65) Prior Publication Data

US 2012/0264045 A1 Oct. 18, 2012

(30) Foreign Application Priority Data

Apr. 15, 2011 (JP) ..... 2011-090690

(51) Int. Cl.

| | |
|---|---|
| ***G03G 5/05*** | (2006.01) |
| ***G03G 15/16*** | (2006.01) |
| ***G03G 15/22*** | (2006.01) |
| ***G03G 15/00*** | (2006.01) |
| ***G03G 9/087*** | (2006.01) |

(52) U.S. Cl.

CPC ..... *G03G 15/1625* (2013.01); *G03G 15/224* (2013.01); *G03G 15/6591* (2013.01); *G03G 9/08702* (2013.01); *G03G 9/08711* (2013.01); *G03G 9/08742* (2013.01); *G03G 9/08755* (2013.01)

USPC ..... 430/125.5; 430/125.31; 430/126.1; 430/123.5; 430/126; 430/109.3; 430/108.2; 430/124

(58) Field of Classification Search

CPC .... G03G 9/08711; G03G 15/14; G03G 13/22

USPC ..... 430/123.5, 126, 109.3, 108.2, 124, 430/125.31, 125.5, 126.1

See application file for complete search history.

(56) References Cited

U.S. PATENT DOCUMENTS

| | | | | |
|---|---|---|---|---|
| 4,599,293 | A * | 7/1986 | Eckell et al. | 430/125.6 |
| 4,868,049 | A * | 9/1989 | Nelson | 428/328 |
| 6,605,174 | B1 * | 8/2003 | Landa et al. | 156/233 |
| 2007/0281236 | A1 * | 12/2007 | Watanabe et al. | 430/123.5 |

FOREIGN PATENT DOCUMENTS

| | | |
|---|---|---|
| JP | 01-200985 | 8/1989 |
| JP | 05-279608 | 10/1993 |
| JP | 08-164663 | 6/1996 |
| JP | 09-001995 | 1/1997 |
| JP | 2004-074422 | 3/2004 |
| JP | 2007-015159 | 1/2007 |
| JP | 2009-090464 | 4/2009 |

* cited by examiner

*Primary Examiner* — Peter Vajda
*Assistant Examiner* — Olatunji Godo
(74) *Attorney, Agent, or Firm* — Lucas & Mercanti, LLP

(57) ABSTRACT

A foil transferring method employing an electrophotography is disclosed, in which a toner used for forming a foil transferring layer contains at least a vinyl based resin and a polyester based resin as a binder resin and an amount of the vinyl based resin is 50 to 95% by weight based on the total amount of the binder resin.

6 Claims, 4 Drawing Sheets

FOIL TRANSFERRING METHOD AND TONER FOR FORMING FOIL TRANSFERRING LAYER

This application is based on Japanese Patent Application No. 2011-090690 filed on Apr. 15, 2011, in Japanese Patent Office, the entire content of which is hereby incorporated by reference.

FIELD OF THE INVENTION

The present invention relates to a foil transferring method in which a layer called a foil transferring layer is formed by supplying a toner to a base material at a portion the foil to be transferred and a foil is transferred to the foil transferring layer, and a toner for forming the foil transferring layer employed in the foil transferring method.

BACKGROUND OF THE INVENTION

In the field of plastic molding such as cosmetic containers, bookbinding, or commercial printing, metallic appearance or an expensive look which cannot be expressed merely by common printing, has been given to a product by conducting a printing processing treatment called as foil stamping on the surface of the base material, by which a character or a picture image formed with a gold, silver or colored foil is transferred onto the surface. By this foil stamping which is also called hot stamping, a foil is transferred using heat and pressure on various base materials such as paper, plastics or leather. This method is one of the most suitable methods to achieve a metallic gloss. Specifically, in this method, a transfer material layer having a foil formed on a plastic support is brought in contact with a base material, and, then, the foil of the transfer material layer is transferred to a base material to form a foil image by conducting thermo-compression using a metal press mold.

In a transfer foil used for the foil stamping, for example, a protective layer, a transfer material layer and an adhesive layer are provided on a releasing agent layer formed on a plastic support made of such as a polyester film, in which the transfer material layer is formed by vacuum evaporated metal or an ink. The technique to produce a transfer foil has been improved in accordance with the enlargement of the market of the transfer foil. For example, researches on a transfer foil having a protective layer containing an organic silicon compound and a reactive organic compound in view of improving the durability of a foil image and on a transfer foil having an electron beam curable adhesive layer by which a stronger protective layer is formed by being irradiated with an electron beam after peeled from the support, have been brought forward (for example, refer to Patent Documents 1 and 2).

In recent years, a hologram is often attached on, for example, a cash card or a credit card in order to prevent falsification or alteration, or for the security of these cards. Such a hologram used for the prevention of falsification of a card has been formed mainly by employing a technique of foil transferring. Since many of these transfer images used for the prevention of falsification or for security of the cards contain a precise pattern, it is required to accurately transfer the image but not to cause a problem such as a burr or missing of the foil. In accordance with such a requirement, there has been examined a transfer foil by which, by incorporating a polymer liquid crystal material in a transfer layer, a precise-shaped label is accurately transferred without causing defects such as burrs or missing of the foil (for example, refer to Patent Documents 3).

On the other side, in order to conduct foil transfer on a base material with a simple process and to stably hold the transferred foil for a long time, advanced has been a technique to form a resin layer on the surface of a base material and to provide a transfer foil on the resin layer, followed by conducting a heat treatment to carry out foil transfer. For example, there has been proposed a technique to form an ink layer on the base material of a product using an emulsion ink in which a hot melt adhesive agent is dispersed and to provide a transfer foil on the ink layer, followed by conducting a heat treatment to carry out foil transfer (for example, refer to Patent Document 4).

Also, proposed has been a technique to form a resin layer on a base material using a toner and to conduct foil transfer via a hot stamp technique using the resin layer as a binder. For example, there has been a technique to transfer a foil on a three dimensional image by forming a protrusion image or a design image on a base material using a toner and placing an adhesive layer of a transfer foil on the toner image surface, followed by heat-pressing with a roller (for example, refer to Patent Documents 5 and 6). Further, there has been a technique regarding a transfer foil having a toner image formed with a dry toner on a substrate, in which a picture image is formed in the toner layer using a printer, followed by transferring onto a base material (for example, refer to Patent Document 7). The techniques given in these patent documents may enable to thermo-compress a transfer foil on the surface of a base material without using a metal pressing member called a press mold. This means that these techniques have intended to improve working efficiency by reducing necessary time for the foil transferring.

PRIOR ART DOCUMENTS

Patent Document 1: JP A H09-001995
Patent Document 2: JP A 2007-015159
Patent Document 3: JP A 2009-090464
Patent Document 4: JP A H05-279608
Patent Document 5: JP A H01-200985
Patent Document 6: JP A H08-164663
Patent Document 7: JP A 2004-074422

SUMMARY OF THE INVENTION

However, the adhesion property between the toner layer formed on the base material and the transfer foil has not been fully considered in each technique disclosed by the above mentioned patent documents. For example, the foil is sometimes transferred onto a portion other than the toner layer when the transfer foil is brought in contacted with the base material, whereby the aesthetic appearance of the product is spoiled due to the foil adheres to a location other than a predetermined place. Also, there has been a durability problem in which the adhesive strength of the foil transferred onto a base material is sometimes not fully obtained, whereby the aesthetic appearance of the product is spoiled due exfoliation of the foil only by a small force. Further, there has been a problem in a productive point of view in which, when foil transfer is conducted onto a base material without using a press, the foil transfer of a prescribed shape cannot be stably carried out due to partial missing of the foil or a burr caused by insufficient affinity of the toner layer with the adhesive layer of the transfer foil.

An object of the present invention is to provide a foil transferring method in which, a transfer foil is certainly transferred on a foil transferring layer formed with a toner on the base material, and the foil transferring layer exhibits a strong adhesion property and an internal cohesive force, whereby aesthetic appearance by a foil can be maintained, as well as to provide a toner for forming a foil transferring layer. Another object is to provide a foil transferring method by which a foil is transferred onto an appointed portion on the base material without using a press mold to exhibit a strong adhesive force between the foil and the foil transferring layer, whereby missing of the foil and burrs are avoided.

One of the aspects to achieve the above object of the present invention is a foil transferring method comprising the steps of:

exposing a photoreceptor to form an electrostatic latent image;

supplying a toner for forming a foil transferring layer to the photoreceptor having thereon the electrostatic latent image to form a foil transferring layer on the photoreceptor;

transferring the foil transferring layer formed on the photoreceptor onto a base material;

fixing the foil transferring layer on the base material;

supplying a transfer foil having at least a foil and an adhesive layer to the base material having the fixed foil transferring layer;

bringing the adhesive layer of the transfer foil in contact with the foil transferring layer;

heating the transfer foil and the foil transferring layer while the adhesive layer of the transfer foil is in contact with the foil transferring layer to adhere the foil onto the foil transferring layer; and removing the transfer foil from the base material while leaving the foil adhered onto the foil transferring layer, wherein the adhesive layer of the transfer foil comprises a thermoplastic resin, the toner for forming a foil transferring layer contains at least a vinyl based resin and a polyester based resin as a binder resin, and a content ratio of the vinyl based resin is 50 to 95% by weight based on the total amount of the binder resin.

It is preferred that the vinyl based resin is contained in an amount of 70 to 90% by weight based on a whole binder resin of the toner.

It is preferred that the vinyl based resin is a styrene acryl resin.

It is preferred that the binder resin is a resin bonding a vinyl based resin to a polyester based resin mutually.

It is preferred that the binder resin is a composite resin bonding a vinyl based resin to a polyester based resin mutually.

Another aspect to achieve the above object of the present invention is a toner for forming a foil transferring layer comprises a binder resin wherein the binder resin comprises a vinyl based resin composed of the radical polymerizable monomer and a vinyl based resin formed by a condensation polymerization, the vinyl based resin composed of the radical polymerizable monomer being contained 50 to 95% by weight based on a whole binder resin.

The foil transferring method of the invention provides a foil transferring method by which a foil is transferred onto an appointed portion without causing missing of the foil and buns by employing a toner for forming a foil transferring layer containing specified amount of a vinyl based resin and a polyester based resin which exhibit a strong adhesive force between the foil and the foil transferring layer.

The toner for forming a foil transferring layer according to the invention a foil having prescribed shape can be transferred to an appointed portion on the base material with high precision without using a jig such as a press mold or the like, since the transfer foil adheres firmly on the foil transferring layer formed with the toner when the transfer foil is brought into contact with the base material.

Consequently, aesthetic appearance of the base material can be improved drastically since a complicated design using fine lines abundantly can be formed by a simple method. Further, it is applicable to forming a hologram image recording a personal information in a card business such as ID cards, and can contribute to manufacturing ID cards recording a plenty of information because a hologram image having a complicated shape.

BRIEF DESCRIPTION OF THE DRAWINGS

FIG. 5 includes a schematic view of foil image samples used as an evaluation in the Examples.

DESCRIPTION OF THE PREFERRED EMBODIMENTS

Figure 1A:
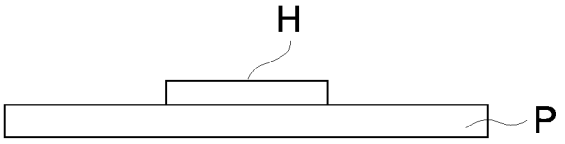
FIGS. 1*a* through 1*e* are schematic diagrams showing a procedure to transfer a foil on a foil transferring layer formed on a base material.

Embodiments practicing the invention are described.

The present invention relates a foil transferring method, in which a layer called a foil transferring layer is formed at a portion on which a foil is transferred on the base material and a foil is transferred on to the layer, used for an improving aesthetic appearance of a base material, as well as a toner for forming a foil transferring layer used for the foil transferring method.

The toner for forming a foil transferring layer contains, at least a vinyl based resin and a polyester based resin, wherein a vinyl based resin is contained at 50 to 95% by weight in this foil transferring method. A foil can be transferred without using a jig such as a press mold by employing the toner, and foil can be transferred onto an appointed portion precisely without missing or burrs of the foil. A foil having prescribed shape without a burr or missing can be transferred certainly on the base material without using a press mold when a foil is transferred. A reason is assumed as follow, why the foil can be transferred the foil on prescribed portion precisely by providing strong adhesive force with on the base material and without causing a burr or missing.

The vinyl based resin used as a component of the toner for forming a foil transferring layer has high affinity with a thermoplastic resin of the adhesive layer in the transfer foil, and is expected to maintain high adhesive property with the adhesive layer of the transferred foil.

The polyester based resin, another component, contains a ester bond having polarity in a backbone chain, and therefore is expected to have high adhesion property with the adhesive layer of the transfer foil similarly since it has high affinity with a portion having high polarity in the vinyl based resin, such as vinyl acetate, vinyl chloride or the like used in the adhesive layer of the transfer foil.

The vinyl based resin is made by a radical polymerization of a polymerizable monomer having unsaturated bond, and therefore its backbone chain is composed of bonding between only carbon atom and carbon atom, but has not polarity. Therefore, internal cohesive force is small, since electrostatic bond is not formed among backbone chain. On the other side, a polyester based resin has large internal cohesive force since it is formed by a condensation polymerization of polyalcohol and polyvalent carboxylic acid, and therefore has an ester bond having polarity within a backbone chain, whereby an electrostatic bond is formed between backbone chains.

Consequently, adhesion property and internal cohesive force are adjusted by blending two kinds of resins having different internal cohesive force, that is, a vinyl based resin and a polyester based resin, and therefore generation of insufficient transferring of the foil specific to toners formed respective resins is prevent, and a toner for forming a foil transferring layer having adequate internal cohesive force without causing a missing or burr can be obtained.

The foil transferring layer is a region of a base material such as an image support material or a plastic component to which a foil is transferred, and is formed by a toner for forming a foil transferring layer.

The foil is used to provide a text image or a picture image having a metallic or glossy appearance which is difficult to be provided via a usual printing on an image support material. The foil includes various kinds of foils according to the application, such as a gold or silver foil to obtain a gold or silver image, a color pigment foil to obtain a color image having metallic gloss and a hologram foil to obtain a hologram image.

The base material is referred as a base material on which a foil transferring layer and a foil layer are formed and includes paper, a plastic component and the like.

Toner for Forming Foil Transferring Layer

The toner for forming a foil transferring layer is supplied on a photoreceptor and forms a toner layer called a foil transferring layer thereon. The foil transferring layer formed on the photoreceptor by the toner for forming a foil transferring layer is transferred and fixed on the sheet-shape base material represented by an image support material. A foil is transferred by that a transfer foil is supplied on the foil transferring layer fixed on the base material, and is subjected to heating to adhere firmly with the transfer foil.

The toner for forming a foil transferring layer contains at least a binder resin. The toner for forming a foil transferring layer is preferably a clear toner.

The clear toner is a toner which is not recognized via light absorption or light scattering. The clear toner is substantially colorless and transparent, and includes a toner containing no colorant such as a pigment or dye, a toner containing colorant such as a pigment or dye slightly so as not to recognize color, a toner having slightly reduced transparency cue to species and an amount of a binder resin, wax and an external additive.

The toner for forming a foil transferring layer has an average particle diameter in terms of a volume based median particle diameter of preferably 3 to 10 μm, and more preferably 6 to 9 μm.

A volume based median particle diameter of the toner is measured and calculated by an apparatus of Coulter Counter Multisizer 3 (produced by Beckman Coulter Inc.) installed with a computer system for data processing (produced by Beckman Coulter Inc.) at a condition of count particles number of 25,000, and an aperture diameter of 100 μm.

Binder Resin

A binder resin composing a toner for forming a foil transferring layer used for a foil transferring method is composed of a vinyl based resin and a polyester based resin, and contains the vinyl based resin of 50 to 95% by weight, and preferably 60 to 90% by weight.

Content ratio of the vinyl based resin in the binder resin is 50 to 95% by weight, and preferably 70 to 90% by weight. Preferable performance is exhibited as a toner for forming a foil transferring layer without appearing deficiencies of each resin in this content. A preferable internal cohesive force of the binder resin can be obtained within the range and good performance is exhibited as the toner for forming a foil transferring layer.

The binder resin used in a toner for forming a foil transferring layer may be composed of mixing respective of a vinyl based resin and the polyester based resin, or may be composed by bonding the vinyl based resin unit and the polyester based resin unit mutually. Miscibility of the vinyl based resin and the polyester based resin can be enhanced by bonding these mutually.

Resins bonding the vinyl based resin and the polyester based resin include a resin in which a polyester based resin unit is bonded to a vinyl based resin, a resin in which a vinyl based resin unit is bonded to a polyester based resin, a composite resin (a hybrid resin) in which a vinyl based resin unit and a polyester based resin unit are bonded within a backbone chain, and miscibility can be enhanced. The vinyl based resin and the polyester based resin are compatibly miscible mutually without localized within a toner particle homogeneously, and property of each resin is exhibited more effectively by virtue of enhancing miscibility.

Polyester Based Resin

Monomers of the polyester based resin include polymerizable monomers containing an alcohol component having two or more valent polyalcohol and a carboxylic acid component having two or more valent polyvalent carboxylic acid.

Examples of alcohol component having two or more valent is preferably alkylene oxide adduct of bisphenol A represented by Formula (I) in view of storage stability of the toner.

Formula (1)

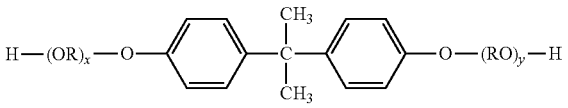

In the formula, RO and OR are an oxyalkylene group, respectively, R is ethylene and/or a propylene group, x and y are both a positive integer showing an addition mol number of the alkylene oxide, average of sum of x and y is preferably 1 to 16, more preferably 1 to 8, and further preferably 1.5 to 4.

Content of the adduct of alkylene oxide in bisphenol A is preferably 50 mol % or more, more preferably 60 mol % or more, further preferably 80 mol % or more and particularly preferably 90 mol % or more in the alcohol component, in view of durability.

An adduct of alkylene oxide of bisphenol A represented by Formula (1) includes ethylene oxide adduct wherein R has 2 carbon atoms, such as polyoxy ethylene 2,2-bis(4-hydroxyphenyl)propane, and wherein R has 3 carbon atoms, such as polyoxy propylene 2,2-bis(4-hydroxyphenyl)propane.

An alcohol component other than adduct of alkylene oxide of bisphenol A includes ethylene glycol, diethylene glycol, 1,2-propylene glycol, 1,4-butanediol, neopentyl glycol, hexane diol, cyclohexane diol, octanediol, decanediol, dodecanedio, polyethylene glycol, polypropylene glycol, bisphenol A, hydrogenation bisphenol A, sorbitol, pentaerythritol, glycerol, trimethylol propane and the like Examples of polyalcohol other than those described above include glycerin, hexamethylol melamine, hexaethylol melamine, tetramethylol benzoguanamine and tetramethylol benzoguanamine.

Examples of the two or more valent carboxylic acid component include oxalic acid, adipic acid, fumaric acid, maleic acid, succinic acid, β-methyl adipic acid, sebacic acid, azelaic acid, nonane dicarboxylic acid, decane dicarboxylic acid, undecane dicarboxylic acid, dodecane dicarboxylic acid, citraconic acid, diglycol acid, cyclohexane 3,5-diene-1,2-dicarboxylic acid, malic acid, citric acid, hexahydro terephthalic acid, malonic acid, pimelic acid, tartaric acid, galactaric acid, phthalic acid, isophthalic acid, terephthalic acid, tetrachlorophthalic acid, chloro phthalic acid, isophthalic acid, p-carboxyacetic acid, p-phenylen diacetic acid, m-phenylene diglycol acid, p-phenylene diglycol acid, o-phenylene diglycol acid, diphenylacetic acid, diphenyl-p,p'-dicarboxylic acid, naphthalene-1,4-dicarboxylic acid, naphthalene1,5-dicarboxylic acid, naphthalene2,6-dicarboxylic acid, anthracene dicarboxylic acid, and dodecenyl succinic acid.

Examples of the two or more valent carboxylic acid component include trimellitic acid, pyromellitic acid, naphthalenetricarboxylic acid, naphthalenetetracarboxylic acid, pyrenetricarboxylic acid and pyrenetetracarboxylic acid.

A monovalent alcohol may be contained in an alcohol component and monovalent carboxylic acid may be contained in a carboxylic acid component in optional amount in view of adjusting molecular weight or improving toner anti-offset property.

Condensation polymerization of the alcohol component and the carboxylic acid component can be conducted, for example, in an ambient of inactive gas at 180° C. to 250° C. It is preferred that it is conducted in the presence of an esterification catalyst, a polymerization inhibitor and the like. Examples of esterification catalyst include a tin (II) compound having no Sn—C such as dibutyl tin oxide, a titanium compound and octylacid tin. These may be used alone or plural in combination.

A crystalline polyester based resin or an amorphous polyester based resin may be used as for the polyester based resin. The crystalline polyester based resin is specific melting property such that viscosity lowers markedly when it is mol in comparison with the amorphous polyester based resin, and the toner containing it gives thickener toner image comparing with image before fixing. The thickened toner image tends to accelerate generation of a burr. Consequently, it is preferred to use the amorphous polyester based resin.

The crystalline polyester based resin is defined as a resin having a distinct endothermic peak but not stepwise endothermic change in measurement of differential scanning calorimeter (DSC) as for the crystallinity of the polyester based resin.

The distinct endothermic peak means practically a peak having a half-value width of endothermic peak is within 15° C., measured via differential scanning calorimeter measurement of (DSC) with rate of temperature rise 10° C./min.

Vinyl Based Resin

It is preferred that at least styrene is used as a polymerizable monomer of the vinyl based resin. Content of styrene is preferably 30 to 95% by weight, more preferably 60 to 92% by weight, and further preferably 80 to 92% by weight among the radical polymerizable monomers, in view of store ability of the toner.

Radical polymerizable monomers other than styrene include vinyl based resin monomers such as styrene derivatives such as α-methylstyrene; ethylenical unsaturated monoolefins such as ethylene, propylene; diolefines such as butadiene; halovinyls such as vinyl chloride; vinyl esters such as vinyl acetate, vinylpropionate; (meth)acrylic acid ester of alkyl having 12 to 22 carbon atoms, esters of ethylenical monocarboxylic acid such as (meth)acrylic acid dimethyl aminoethyl; vinyl ethers such as vinyl methyl ether; vinylidene halogenates such as vinylidene chloride; and N-vinyl compounds such as N-vinyl pyrrolidone. Preferable among these is (meth)acrylic acid ester of alkyl having 12 to 22 carbon atoms, which has long chain alkyl groups on the side chain, in view of easiness of polymerization reaction control and an anti-high temperature off-set property of the toner. Consequently, styrene-(meth)acrylic acid ester resin is preferable as the resin. The term of "(meth)acrylic" or "(meth)acrylate" includes methacrylic and acrylic, and methacrylate and acrylate, respectively.

Number of carbon atoms of alkyl group in the (meth) acrylic acid ester of alkyl is preferably 12 to 22, and more preferably 14 to 22.

Content of (meth)acrylic acid ester of alkyl having 12 to 22 carbon atoms is preferably 5 to 70% by weight, more preferably 8 to 40% by weight, and further preferably 8 to 20% by weight, among radical polymerizable monomers.

Weight ratio of styrene to (meth)acrylic acid ester of alkyl having 12 to 22 carbon atoms, (styrene/(meth)acrylic acid ester of alkyl having 12 to 22 carbon atom) is preferably 100/50 to 100/5, and more preferably, 100/30 to 100/5, in view of anti-high temperature off-set property toner.

Total content of styrene and (meth)acrylic acid ester of alkyl having 12 to 22 carbon atoms is preferably 70% by weight or more, more preferably 80% by weight or more, and particularly preferably, 90% by weight or more among polymerizable monomers of a radical polymerization resin.

A polymerizable monomer containing a carboxylic group may be incorporated as a radical polymerizable monomer composing the styrene acryl resin. It is preferred that adhesion property between a toner for forming a foil transferring layer and paper is improved by incorporating polymerizable monomer containing the carboxylic group as a copolymerization component.

Monomers containing the carboxylic group include acrylic acid, methacrylic acid, itaconic acid, maleic acid, fumaric acid, mesaconic acid, citraconic acid, 2-pentene-2-acid, allyl malonic acid, isopropylidene succinic acid, 2,4-hexanediene-2-acid, acetylene dicarboxylic acid, and aconitic acid. These may be used alone or mixing two or more in combination.

The radical polymerization reaction can be conducted in the presence of for example, a chain transfer agent, a radical polymerization initiator, a crosslinking agent, in an organic solvent, or without organic solvent in usual way. Temperature condition is preferably 60° C. to 98° C.

Example of the chain transfer agents include mercaptan such as octylmercaptan, dodecylmercaptan, and tert-dodecylmercaptan, n-octyl-3-mercaptopropionic acid ester, terpineol, carbon tetrabromide and α-methylstyrene dimer. Amount to be added of the chain transfer agent varies depending on a targeted molecular-weight or molecular-weight distribution and it is preferable to add 0.1 to 5% by weight based on polymerizable monomers practically.

The radical polymerization initiator can be selected from water soluble polymerization initiators and oil soluble polymerization initiators according to polymerization methods. The water soluble polymerization initiator can be used when the resin particles are formed by an emulsion polymerization method. The water soluble polymerization initiators include persulfate such as potassium persulfate, ammonium persulfate, azobis aminodipropane acetic acid salt, azobis cyanovalerianic acid and its salt, and hydrogen peroxide.

The oil soluble polymerization initiators include azo type or diazo type polymerization initiators such as 2,2'-azobis(2,4-dimethyl valeronitrile), 2,2'-azobisisobutylonitrile, 1,1'-azobis(cyclohexane 1-carbonitrile), 2,2'-azobis-4-metoxy-2,4-dimethyl valeronitrile, and peroxide type polymerization initiators or polymer initiators having peroxide on side chains such as benzoylperoxide, methyl ethyl ketone peroxide, diisopropyl peroxycarbonate, cumene hydroperoxide, t-butyl hydroperoxide, di-t-butylperoxide, di-cumyl peroxide, 2,4-di-chlorobenzoyl peroxide, lauroyl peroxide, 2,2-bis(4,4-t-butylperoxycyclohexyl)propane and tris-(t-butylperoxy)triazine. These may be used alone or in combination.

Existence amount of the radical polymerization initiator in a reaction system is preferably 10 to 25 parts by weight, and more preferably 12 to 22 parts by weight with reference to total amount of radical polymerizable monomers 100 parts by weight in view of controlling peak top value molecular-weight radical polymerization resin, and improving low temperature fixing property, anti-high temperature off-set property and durability of the toner.

Composite Resin

A binder resin used for the toner for forming a foil transferring layer is composed of at least a vinyl based resin and a polyester based resin. These two kinds of resins may be used as a mix of respective resins, and it is preferable to use as a composite resin composed by bonding a styrene acryl resin unit to a polyester based resin unit, preferably, and further a preferable result is obtained when composite resin (a hybrid resin) bonding a radical polymerizable monomer and a condensation polymerization monomer via a dual reactive monomer which react with both is used as a toner for forming a foil transferring layer.

The composite resin includes a composite resin composed of a styrene acryl resin unit as a backbone chain and polyester based resin units bonded via a dual reactive monomer and a composite resin composed of a polyester based resin unit as a backbone chain and styrene acryl resin units bonded via a dual reactive monomer. Further, a composite resin composed of polyester based resin end of which a styrene acryl resin units are bonded, and a resin composed on a polyester based resin on which vinyl based resin units are grafted may be used.

A compound which reacts with both of a polymerizable monomer forming a condensation polymerization resin and a polymerizable monomer forming radical polymerization resin (a dual reactive monomer) may be used as polymerizable monomers of the composite resin. According to this, a polyester based resin component and a vinyl based resin component are bonded to via the dual reactive monomer (strictly a composing unit after the dual reactive monomer is reacted) partly, and a resin in which a polyester based resin component and a vinyl based resin component are dispersed minutely and homogeneously is obtained. The composite resin formed by a vinyl based resin component and a polyester based resin component are bonded via a dual reactive monomer is also called a hybrid resin.

The dual reactive monomer in the former composite resin is preferably a compound having an ethylenical unsaturated bond and at least one kind of functional groups selected from a group consisting of a hydroxy group, a carboxylic group, an epoxy group, a primary amino group and a secondary amino group, preferably a hydroxy group, and/or a carboxylic group, more preferably a carboxylic group, i.e., vinyl based carboxylic acid. Practical examples of the dual reactive monomers include acrylic acid, methacrylic acid, fumaric acid and maleic acid, and further ester of hydroxy alkyl having 1 to 3 carbon atoms of these compounds. The preferable examples are acrylic acid, methacrylic acid, fumaric acid and maleic acid is preferable in view of a reaction property.

It is preferable to use monovalent vinyl based carboxylic acid in comparison to polyvalent vinyl based carboxylic acid as the dual reactive monomer in the former composite resin in view of durability. It is assumed that the monovalent vinyl based carboxylic acid can be hybridized easily because it has a high reaction property with polymerizable monomers of the radical polymerization resin.

It is preferable that polyvalent carboxylic acid having an ethylenical unsaturated group is used as polyvalent carboxylic acid component composing the polyester based resin in the dual reactive monomer in the latter composite resin. Ethylenical unsaturated groups are introduced in a polyester based resin by employing polyvalent carboxylic acid having unsaturated bond within a molecule as monomer composing the polyester based resin, i.e., polyvalent carboxylic acid component. The polyester based resin modified grafted styrene acryl graft can be formed by grafting radical polymerizable monomers such as styrene, and acrylic acid ester. Maleic acid and fumaric acid are used adequately as the polyvalent carboxylic acid to which ethylenical unsaturated bond is introduced.

Used amount of the dual reactive monomers is preferably 1 to 10 parts by weight, more preferably, 4 to 8 parts by weight with reference to the total amount of the radical polymerizable monomer 100 parts by weight, and preferably 0.3 to 8 parts by weight, more preferably 0.5 to 5 parts by weight with reference to total amount of the polymerizable monomer 100 parts by weight of the condensation polymerization resin in view of improving low temperature fixing property, anti-high temperature off-set property and durability of the toner.

It is preferable that condensation polymerization reaction and radical polymerization reaction are conducted in the same reaction vessel to manufacture the composite resin. And respective progress and completion of the polymerization reaction are not same time necessarily. Reaction may be conducted and completed reaction temperature and time are selected adequately in accordance with polymerization reaction mechanism.

The practical manufacture method of the composite resin includes the followings.

(1) Condensation polymerization reaction is conducted after radical polymerization reaction, 3 or more valent polymerizable monomers as a crosslinking agent for forming a condensation polymerization resin is added to reaction system if necessary, and condensation polymerization reaction is further progressed.

(2) Radical polymerization reaction is conducted after condensation polymerization reaction, after the radical polymerization reaction, 3 or more valent polymerizable monomers as a crosslinking agent for forming a condensation polymerization resin is added to reaction system if necessary, and the condensation polymerization reaction is further progressed under temperature condition suitable for the condensation polymerization reaction.

(3) radical polymerization reaction and condensation polymerization reaction are conducted in parallel under temperature condition suitable for the radical polymerization reaction, after completion of the radical polymerization reaction, 3 or more valent monomers as a crosslinking agent for forming the condensation polymerization resin are added to the reaction system if necessary, and the condensation polymerization reaction is further progressed under temperature condition suitable for condensation polymerization reaction.

(4) A radical polymerization is conducted by adding radical polymerizable monomers to a polyester based resin having unsaturated bond, and reacting unsaturated bond portions of the polyester based resin with radical polymerizable monomers.

The composite resin is practically manufactured by a process of, for example, employing a dual reactive monomer as well as a polymerizable monomer of a condensation polymerization resin and/or a polymerizable monomer of radical polymerization resin, (preferably a polymerizable monomer of a radical polymerization resin), condensation polymerization is conducted by allowing the condensation polymerization resin to exist in the radical polymerization reaction system at least at any timing of before, during and after the radical polymerization process of the polymerizable monomer of the radical polymerization resin, since the condensation polymerization resin and the radical polymerization resin are bonded via a dual reactive monomer.

A softening point of the above described composite resin is preferably 125° C. to 150° C., and more preferably 120° C. to 140° C. in view of a low temperature fixing property, an anti-high temperature off-set property and durability of the toner. The low temperature fixing property of the toner is excellent when the softening point of the composite resin is not more than 150° C., and toner is excellent in anti-high temperature off-set and durability at not less than 125° C. The softening point of the resin can be easily controlled by selecting polymerizable monomer components, polymerization initiator, an amount of catalyst and the like, or selecting reaction condition, and it is preferable to employ a method enhancing rate of polymerization reaction by elongating reaction period because of easy reaction control.

A ratio of molecular-weight peak top value of the radical polymerization resin to softening point (° C.) of the above described composite resin (molecular-weight peak top value/softening point) is preferably 10 to 40, and more preferably 12 to 33, in view of low temperature fixing property, anti-high temperature off-set property, and durability of the toner. Softening point of the composite resin relates to a molecular-weight of composite resin as a whole, and a ratio of a molecular-weight of the radical polymerization resin to the molecular-weight the composite resin as a while can be expressed in terms of a ratio of molecular-weight peak top value of the radical polymerization resin to softening point. The toner is excellent in durability in case of the value is not less than 10, and toner is excellent in also a low temperature fixing property and an anti-high temperature off-set property in case of not more than 40.

Thus a binder resin of the toner for forming a foil transferring layer is obtained. Since the molecular-weight peak top value of the radical polymerization resin is not more than 5,500 in the binder resin of the toner for forming a foil transferring layer, a molecular-weight of the condensation polymerization resin can be made larger, and therefore, a foil transferring method is provided in which a foil can be transferred to the predetermined portion without generation of missing or burrs of the foil.

Wax

The toner for forming a foil transferring layer may be added with a wax. Examples of a usable wax include the following compounds.

(1) Hydrocarbon Wax:

Polyolefin wax such as paraffin wax, polyethylene wax and polypropylene wax, and sazole wax;

(2) Ester Wax:

Trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristearate and distearyl maleate;

(3) Amide Wax:

Ethylenediamine dibehenylamide and trimellitic acid tristearylamide;

(4) Dialkyl Ketone Wax:

Distearyl ketone;

(5) Other Wax:

Carnauba wax and montan wax.

Hydrocarbon wax includes a straight-chain hydrocarbon compound, a branched-chain hydrocarbon compound, a hydrocarbon compound having a cyclic structure on the molecular structure and the like according to its molecular structure.

The straight-chain hydrocarbon compound includes, for example, petroleum wax composed of paraffin wax called normal paraffin as a main component, and polyolefin wax such as Fischer-Tropsch wax, polyethylene wax and polypropylene wax. The paraffin wax is obtained by separating from extracted oil by reduced-pressure distillation via usual method. Fischer-Tropsch wax is obtained by distillation of hydrocarbon synthesized from synthesized gas composed of carbon monoxide and hydrogen, or a hydrocarbon compound having 16 to 78 carbon atoms obtained by hydrogenation of these compounds. Polyethylene wax and polypropylene wax are obtained by polymerization of ethylene and propylene, respectively, or heat decomposition of polyethylene and polypropylene, respectively.

As examples of a branched-chain hydrocarbon compound and a hydrocarbon compound having a cyclic structure in the molecule, the following microcrystalline waxes and waxes having isoparaffin as a main component may be cited. Examples of a microcrystalline wax include: HNP-0190, Hi-Mic-1045, Hi-Mic-1070, Hi-Mic-1080, Hi-Mic-1090, Hi-Mic-2045, Hi-Mic2065 and Hi-Mic-2095, all produced by Nippon Seiro Co., Ltd. Microcrystalline waxes, as described herein, refer to those in which the ratio of a branched-chain hydrocarbon referred to as an isoparaffin and a cyclic hydrocarbon referred to as a cycloparaffin is greater. Generally, since a microcrystalline wax incorporates a large amount of low crystalline isoparaffin and cycloparaffin, crystals are smaller than those of a paraffin wax, while the molecular weight thereof is greater than that of a paraffin wax. The number of carbon atoms, the number average molecular weight Mn, and the melting point of the aforesaid microcrystalline wax are 60 to 150, 900 to 2000, and 60 to 90° C., respectively.

Specific examples of a wax having isoparaffin as a main component include EMW-0001 and EMW-0003.

Manufacturing Method of Toner

A manufacturing method of a toner for forming a foil transferring layer is described.

The toner for forming a foil transferring layer comprises a resin formed via condensation polymerization reaction and a resin formed via a radical polymerizable monomer. A manufacturing method of toners used in the electrophotographic image forming can be applied to the manufacturing method of particles composing the toner. That is, such a method can be applied as so called a pulverization method in which toner is manufactured via processes of kneading, pulverization and classification, and so called a polymerization method in which particles are formed by polymerization of a polymerizable monomer and simultaneously controlling the shape or particle size.

It is said that the toner manufactured by the polymerization method is easy to obtain properties such as uniform particle size distribution, uniform shape distribution and sharp charge distribution among them. The manufacturing method by polymerization method has a process to form resin particles by polymerization reaction such as suspension polymerization and emulsion polymerization. It is particularly preferable to manufacture via association process in which resin particles manufactured by polymerization are subjected to coagulation and fusion to form particles.

A manufacturing method of the toner by emulsion association method will be described as an example. The manufacturing method of the toner by emulsion association method is conducted, for example, by the following processes.

(1) Process of preparation of dispersion liquid of resin particles (2) Process of coagulation and fusion of the resin particles (Process of association)

(3) Process of ripening (4) Process of cooling (5) Process of washing (6) Process of drying (7) Process of adding an external additive Each process will be described.

(1) Manufacturing Process of Resin Microparticles Dispersion

This is a process to form a resin composing a toner. Manufacturing dispersion of microparticles of a radical polymerization resin is conducted. Practically, at least, mixture of polymerizable monomers such as a radical polymerizable monomer described above is dispersed in an aqueous medium, an emulsion polymerization reaction is conducted under this condition to form resin microparticles, for example.

In this process, polymerizable monomers including a radical polymerizable monomer are added in an aqueous medium, thereafter emulsion dispersion treatment is conducted to form oil droplets of mixture of polymerizable monomers. Subsequently resin microparticles are formed by conducting radical polymerization reaction inside of oil droplets dispersed in an aqueous medium.

The radical polymerization reaction is a process wherein a polymerization initiator is incorporated inside of the above described oil droplets to generate radicals, polymerization reaction of the polymerizable monomer forming the oil droplets is initiated, and resin is formed by the polymerization reaction. Polymerization reaction can be initiated by supplying radicals generated from the polymerization initiator added in the aqueous medium into oil droplets by known method in other way.

Temperature during the radical polymerization depends on the species of a polymerizable monomer including the polymerizable monomer having a carboxyl group and an initiator generating radicals, and usually is preferably 50 to 100° C., and more preferably 55 to 90° C. The reaction time, which depends on reaction rate of polymerizable monomer used in the polymerization reaction or generated radicals, is preferably 2 to 12 hours.

In this process, mixture including at least a radical polymerizable monomer and a polymerizable monomer are added in an aqueous medium, subsequently oil droplets of the monomers are formed by subjecting dispersion process via an activity of mechanical energy. Dispersion apparatus in which oil droplets dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably about 100 nm.

A term of aqueous medium is a liquid containing water and an organic solvent soluble in water, containing at least 50% by weight of water. As components other than water are cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

Dispersion of microparticles of a condensation polymerization resin, or a hybrid resin composed of a condensation polymerization resin and radical polymerization resin is manufactured by, for example, the processes of; dissolving the resin in an organic solvent preliminarily, dispersing it as oil droplets in an aqueous medium, then removing, an organic solvent by distillation, and dispersion of microparticles of condensation polymerization resin or a hybrid resin is obtained.

The above described dispersion apparatus using an activity of mechanical energy can be employed as a dispersion apparatus to disperse the condensation polymerization resin or the hybrid resin as oil droplets in an aqueous medium.

(2) Process of Coagulation and Fusion of the Resin Particles (Association Process)

This is a process to form particles by coagulating resin microparticles formed by the above described process and to form particles for toner having no external additives by fusing the coagulated particles, the process being referred to an association process. Particles are manufactured by coagulating and fusing the resin particles formed by polymerizing polymerizable monomer having a carboxylic acid group and other polymerizable monomer.

In this process, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. When allowing coagulation to proceed and reach the targeted particle size, a salt such as sodium chloride is added to stop coagulation.

(3) Ripening:

Ripening is a step of shape controlling step following the coagulation and fusing step, and a system including coagulated particles is stirred with heating, until the shape of toner particles reaches the intended average circularity.

(4) Cooling:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(5) Washing:

In the washing step, a solid-liquid separation treatment of separating toner particles from a toner particle dispersion is conducted, then cooled to the predetermined temperature in the foregoing step and a washing treatment for removing adhered material such as a surfactant or coagulation agent from a separated toner particles aggregate in a cake form is applied.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press.

(6) Drying:

In this step, the washed toner cake is subjected to a drying treatment to obtain dried colored particles. Drying machines usable in this step include, for example, a spray dryer, a vacuum freeze-drying machine, or a vacuum dryer. A standing plate type dryer, a movable plate type dryer, a fluidized-bed dryer, a rotary dryer or a stirring dryer is preferably used.

The moisture content of the dried toner particles is preferably not more than 5% by mass, and more preferably not more than 2% by mass. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(7) External Additive Addition:

In this external additive treatment step, external additives or a lubricant is added to dried toner mother particles. Toner mother particles which were subjected to the drying step may be used as toner particles, but addition of external additives can enhance the electrostatic-charging property, fluidity and cleaning property. External additives usable in the present invention include, for example, organic or inorganic particles and aliphatic metal salts. An external additive is added preferably in an amount of 0.1 to 10.0% by mass, and more preferably 0.5 to 4.0% by mass. A variety of additives may be combined. Examples of a mixing device, used to add external additives include a tabular mixer, a HENSCHEL mixer, a NAUTA mixer, a V-type mixer and a coffee mill.

Inorganic particles may be employed. Specifically, it is possible to preferably employ minute silica, titanium, and alumina particles and the like. These minute inorganic particles subjected to hydrophobic processing may be used.

Specifically listed as silica particles, for example, are commercially available R-805, R-976, R-974, R-972, R-812, and R-809, produced by Nippon Aerosil Co. Ltd.; HVK-2150 and H-200, produced by Hoechst AG; commercially available TS-720, TS-530, TS-610, H-5, and MS-5, produced by Cabot Corp; and the like.

Listed as titanium particles, for example, are commercially available T-805 and T-604, produced by Nippon Aerosil Co.; commercially available MT-100S, MT-100B, MT-500BS, MT-600, MT-600SS and KA-1, produced by TAYCA CORPORATION; commercially available TA-300SI, TA-500, TAF-130, TAF-510 and TAF-510T, produced by Fuji Titanium Industry Co., Ltd.; commercially available IT-S, IT-OA, IT-OB and IT-OC, produced by Idemitsu Kosan Co.; and the like.

Listed as alumina particles, for example, are commercially available RFY-C and C-604, produced by Nippon Aerosil Co., commercially available TTO-55, produced by ISHIHARA SANGYO KAISHA, LTD., and the like.

Further, employed as fine organic particles are fine spherical organic particles having a number average primary particle diameter of 10 to 2,000 nm. Employed as such particles may be homopolymers or copolymers of styrene or methyl methacrylate.

The toner for forming a foil transferring layer can be manufactured via emulsion association process through the steps described above.

Polymerization initiator, dispersion stabilizer, surfactant and the like which can be used in the emulsion association method manufacturing the toner according to the present invention will be described.

A binding resin composing the toner according to the present invention is formed by employing a polymerizable monomer having a carboxyl group on a side chain as described above, and oil soluble or water soluble polymerization initiator can be used Practical example of the oil soluble initiator includes azo type and diazo type polymerization initiators and a peroxide initiator described below.

(1) Azo Based or Diazo Based Polymerization Initiators;

2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

(2) Peroxide Based Polymerization Initiators;

benzoyl peroxide, methyl ethyl ketone peroxide, diisopropylperoxy dicarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-di-t-butylperoxycyclohexyl)propane, and tris-(t-butylperoxy) triazine.

Water soluble radical polymerization initiator can be used when the resin particles are formed by an emulsion polymerization method. The water soluble radical polymerization initiator includes a persulfate salt such as potassium persulfate or ammonium persulfate; azobisaminodipropane acetic acid salts; azobiscyanovaleric acid and salts thereof; and hydrogen peroxide.

Chain Transfer Agent

Chain transfer agents can be employed in order to regulate the molecular weight of the targeted core forming binder resin. A chain transfer agent used for the present invention is not specifically limited. Examples of a chain transfer agent include: a mercaptan such as n-octylmercaptan, n-decylmercaptan, or tert-dodecylmercaptan; a mercaptopropionic acid ester such as n-octyl-3-mercaptopropionic acid ester; terpinolene; and α-methylstyrene dimer.

Dispersion Stabilizer

The toner is manufactured by polymerizing vinyl type monomers including polymerizable monomer containing carboxyl group described above in a state of aqueous dispersion, then dispersing the prepared resin particles, which are coagulated and fused to manufacture the toner. It is preferable to use dispersion stabilizers so as to disperse these toner raw materials stably in aqueous medium. Examples of dispersion stabilizers include tricalcium phosphate, magnesium phosphate, zinc phosphate, aluminum phosphate, calcium carbonate, magnesium carbonate, calcium hydrate, magnesium hydrate, aluminum hydrate, calcium metasilicate, calcium sulfate, barium sulfate, bentonite, silica and alumina. Further, polyvinyl alcohol, gelatin, methylcellulose, sodium dodecylbenzene sulfonate, an ethyleneoxide adduct and high alcohol sodium sulfate, which are usually usable as surfactants, can also be utilized as dispersion stabilizers.

It is necessary to disperse the oil droplets of the polymerizable monomer described above in an aqueous medium stably using a surfactant when the polymerization is conducted employing the polymerizable monomers in the aqueous medium. Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate, etc.

Sulfonic ester salts includes sodium dodecylsulfate sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples include as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide and sorbitan ester.

Foil Transferring Method

A method of foil transfer employing the toner for forming a foil transferring layer (hereafter also referred to as a method of foil transfer) will be described. The method of foil transfer contains at least the following steps (1) to (8).

(1) a step of exposing a photoreceptor to form an electrostatic latent image, (2) a step of forming a foil transferring layer by supplying a toner for forming a foil transferring layer to the photoreceptor on which the electrostatic latent image is formed, (3) a step of transferring the foil transferring layer formed on the photoreceptor onto a base material, (4) a step of fixing the foil transferring layer transferred on the base material by heating, (5) a step of supplying a transfer foil having at least an adhesive layer to the base material having the fixed foil transferring layer, (6) a step of bringing the adhesive layer of the supplied transfer foil in contact with the base material, (7) a step of heating the transfer foil and the foil transferring layer while the adhesive layer of the transfer foil is in contact with the foil transferring layer, and (8) a step of removing the transfer foil from the base material while leaving a portion of the transfer foil adhered on the foil transferring layer.

The foil transferring layer formed on the photoreceptor may be transferred via an intermediate transfer member in the step (3).

Thus, in the method of foil transfer of the present invention, at first, a photoreceptor is exposed to form an electrostatic latent image having the shape of the foil transferring layer to be formed on the product and the toner for forming a foil transferring layer of the present invention is supplied to the photoreceptor on which the electrostatic latent image is formed, whereby a foil transferring layer is formed. The foil transferring layer formed on the photoreceptor is transferred onto a base material, and a transfer foil is supplied onto the base material having the foil transferring layer which is fixed by heating to be in contact with the base material. Under this state, the transfer foil and foil transferring layer are heated to transfer the foil onto the foil transferring layer.

As described above, it has become possible to carry out foil transfer with high precision without using a press while avoiding missing of the foil and burrs by employing a toner containing a binder resin containing at least a condensation polymerization resin and a radical polymerization resin, whereby it has become possible to conduct transfer of a foil having a difficult shape design of a thin line image of which contact area is difficult to obtain. Such foil transfer reproducing with fidelity had been difficult in conventional techniques. Further, even when such a design of a thin line image of which the contact area is difficult to keep is transferred on a base material, the transferred foil is hardly peeled due to the strong adhesive force, whereby loss of aesthetic appearance of the product due to peeling of the foil tends not occur.

The method of foil transfer of the present invention will be specifically described using figures. FIGS. 1*a* to 1*e* are schematic figures illustrating the procedure of the foil transfer method containing the steps (4) through (8) among the above steps (1) through (8). Transfer foil F is supplied on base material P obtained by forming foil transferring layer H on the base material P which has been prepared through steps (1) through (3) which are not shown in FIGS. 1*a* to 1*e*, and the supplied transfer foil F is brought in contact with the foil transferring layer H. Under this state, heating is carried out to transfer the foil f2 on the foil transferring layer H. Hereafter, steps (a) to (e) shown in FIGS. 1*a* to 1*e* will be specifically described.

FIG. 1*a* is a cross-sectional view of the base material P prepared by forming a foil transferring layer on sheet-like base material P using the toner of the present invention. The method of forming foil transferring layer H on base material P through the manufacturing steps of above-mentioned (1) through (3) will be mentioned later.

Figure 1B:
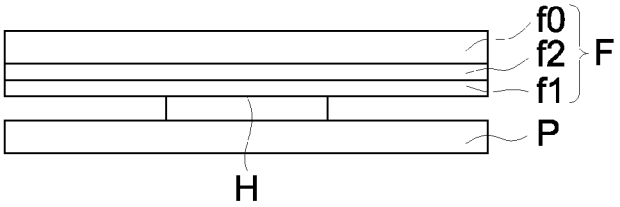

FIG. 1*b* shows the state in which the transfer foil F which has at least an adhesive layer f1 is supplied to the base material P. The transfer foil F is provided so that the adhesive layer f1 is in contact with the foil transferring layer H. At this time, it is considered that the adhesive layer f1 of the supplied transfer foil F is in contact with all over the base material P. Accordingly, the adhesive layer f1 is in contact with the foil transferring layer H which is formed on the base material with a protrude form. It is expected that an adhesive condition is formed between the adhesive layer f1 of the transfer foil F and the foil transferring layer H according to the effect of the aforementioned carboxyl group, on the foil transferring layer H formed with the toner of the present invention. As one of the aspects of the present invention, a transfer foil F has at least an adhesive layer f1 and a foil layer f2 on a film f0 used as a substrate. A layer other than the adhesive layer f1 and the foil layer f2 is omitted here. A detailed explanation of the transfer foil F usable in the present invention will be given later.

Figure 1C:
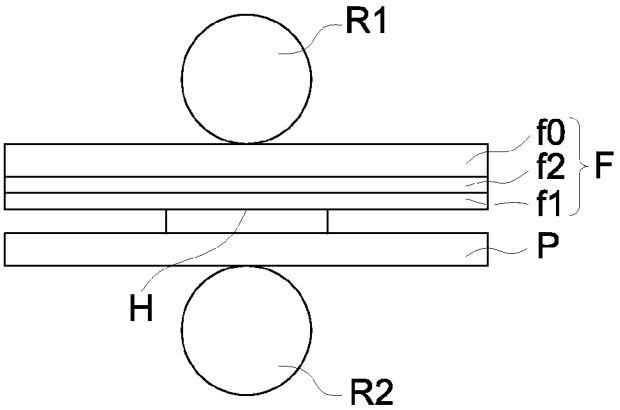

FIG. 1*c* shows a state in which the base material P is passed between the heat-pressure rollers R1 and R2 which are heating media while the transfer foil F is in contact with the base material P, in which the adhesive layer f1 of the transfer foil F is in contact with the foil transferring layer H on the base material P while it is passed between the heat-pressure rollers R1 and R2 which are heating media. By passing through between the heat-pressure rollers R1 and R2, the adhesive layer f1 of the transfer foil F is melted, and the adhesive layer f1 is cooled to be hardened after passing. At this time, the adhesive layer f1 of a portion which is in contact with the foil transferring layer H forms a firm adhesion state between the foil transferring layers H by mingling with f1 and H. Thus, in the present invention, the transfer foil F forms an adhesion state between the foil transferring layers H through the adhesive layer f1 in contact with the foil transferring layer H formed in a protruded state on the base material P. Accordingly, it is possible to transfer the foil layer f2 in a shape faithful to the shape of the foil transferring layer H from the transfer foil F.

Figure 1D:
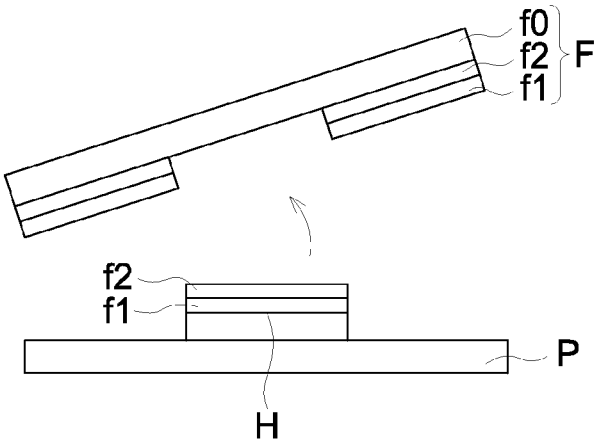

FIG. 1*d* shows the state of removing the transfer foil F from the base material P and, when the transfer foil F is removed, foil layer f2 is transferred together with the adhesive layer f1 only on the foil transferring layer H on the base material P. Here, using the toner for forming a foil transferring layer of the present invention, it is possible to transfer foil layer f2 in a shape corresponding to the shape of the foil transferring layer H, which enables to accurately transfer foil layer f2 of a prescribed shape without using a metal press while avoiding missing of the foil or burrs.

Therefore, according to the present invention, by using a foil transfer apparatus with an simple and compact structure without using a metal press, it is possible to conduct foil transfer of a prescribed shape free from missing of the foil and burrs, whereby it is possible to produce a product P having a high quality foil image with a simple foil transfer apparatus.

Figure 1E:
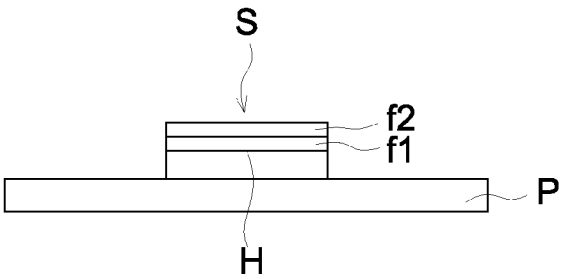

Foil image S is formed by that foil layer f2 is transferred via foil transferring layer H prepared by the toner for forming a foil transferring layer on the base material (image support) P, according to the above described steps as shown in FIG. 1*e*.

An example of the foil transferring layer formation devices which enables to form a foil transferring layer on a base material employing the foil transfer method of the present invention will be explained using FIG. 2. The foil transferring layer formation device 1 in FIG. 3 enables to perform the steps (1) to (3) among steps (1) to (8), and it has a photoreceptor which forms an electrostatic latent image by light exposure. A foil transferring layer corresponding to the electrostatic latent image is formed by supplying the toner for forming a foil transferring layer of the present invention to the photoreceptor, followed by transferring the formed foil transferring layer onto a base material.

Figure 2:
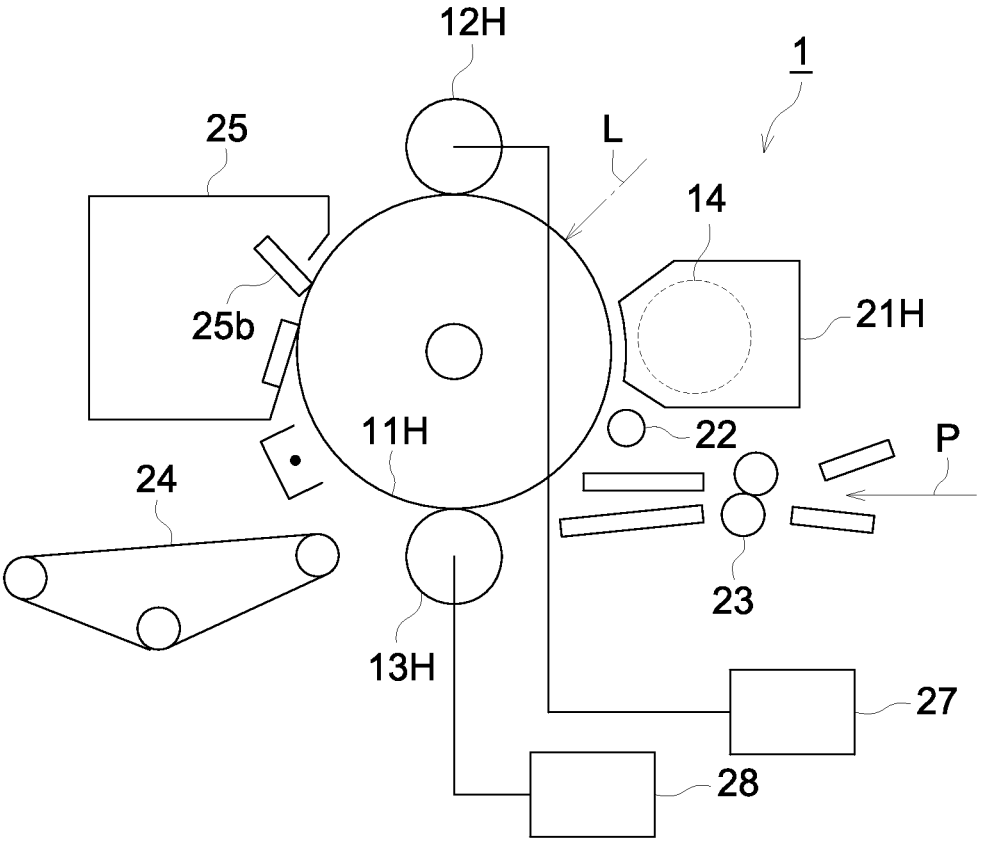
FIG. 2 is a schematic diagram of a foil transferring layer formation device to form a foil transferring layer via an electrostatic latent image method.

The foil transferring layer formed with a toner on the photoreceptor is transferred directly to base material P in the process shown in FIG. 2. This example is not applicable to an image forming apparatus of FIG. 3 described later. The foil transferring layer formed with a toner on the photoreceptor is transferred to once intermediate transfer body 16, and then is transferred to base material P.

In the foil transferring layer formation device 1 of FIG. 2, an electrostatic latent image is formed on the photoreceptor 11H charged with the charging roller 12H in the figure, when the photoreceptor is irradiated with the exposing light L. From the toner feeder 21H of a toner for forming a foil transferring layer provided in the vicinity of the photoreceptor 11H, a toner for forming a foil transferring layer is supplied to the electrostatic latent image formed on the photoreceptor 11H to form a foil transferring layer. At this time, the toner feed roller 14 built in the toner supplying device 21H of a toner for forming a foil transferring layer is rotated to supply the toner attached on the toner feed roller 14 to the photoreceptor 11H, whereby a foil transferring layer is formed on the photoreceptor 11H.

Subsequently, when the electric charge on Photoreceptor 11H is neutralized with the neutralizing lamp 22, the foil transferring layer on the Photoreceptor 11H is transferred onto the substrate p1 which constitutes the base material P in the transfer section where the Photoreceptor 11H and the transfer roller 13H are placed close to each other. The substrate p1 which is a sheet like material, typically a transfer paper, shown in FIG. 2 is conveyed from the paper cassette which is not illustrated to the transfer section by the conveying roller 23, where an electric charge of the reverse polarity with the polarity of the toner for forming a foil transferring layer is given to the substrate p1 by the transfer roller 13H. The foil transferring layer is transferred onto the substrate p1 from the photoreceptor 11H according to an electrostatic action of the electric charge of the reverse polarity given by the transfer roller 13H.

The base material P on which the foil transferring layer is transferred is conveyed to the fixing device which is not illustrated by the conveyance belt 24, after separated from the photoreceptor 11H. The fixing device has a fixing means, for example, a heating roller and a pressure roller, and melts the foil transferring layer formed on the base material P to fix the foil transferring layer.

According to the aforementioned procedure, in the foil transferring layer formation devise 1 shown in FIG. 2, an electrostatic latent image corresponding to the shape of the foil is formed on the photoreceptor 11H, a toner for forming a foil transferring layer is supplied on the photoreceptor 11H to form a foil transferring layer, and the foil transferring layer formed on the photoreceptor 11H is transferred onto the base material P which constitutes the base material product P with the transfer roller 13H.

Figure 3:
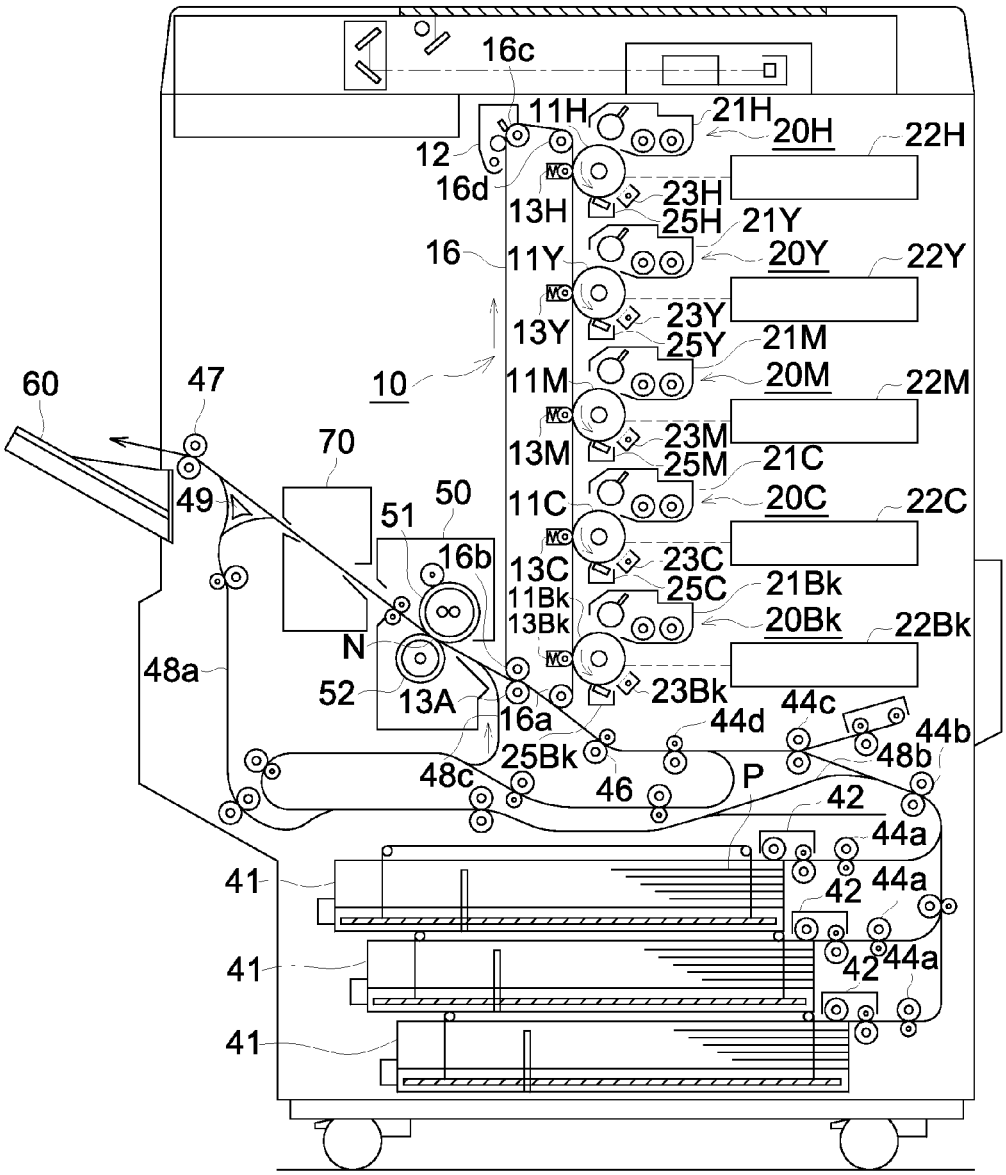
FIG. 3 is a cross-sectional diagram of a foil transferring layer formation apparatus which simultaneously performs formation of a foil transferring layer and full color image formation.

The charging roller 12H shown in the figure charges the photoreceptor 11H according to the following procedure. The charging roller 12H is applied with a bias voltage which is composed of a direct-current (DC) component and an alternating current (AC) component from the power supply 27 to charge the photoreceptor drum 11H. The charging method used for the charging roller 12H shown in FIG. 2 is called a contact charging method, and, in the present invention, a non-contact charging method used in the device which will be explained later in FIG. 3 is also applicable to charge the photoreceptor besides the charging system shown in FIG. 2. The bias voltage impressed to the charging roller 12H is a superimposed voltage of, for example, a DC bias of ±500 to 1,000V which is a direct current component, and an AC bias of 100 Hz to 10 kHz and 200 to 3,500V which is an alternating current component.

The transfer roller 13H in FIG. 2 is also impressed with a bias voltage containing both a direct current (DC) component and an alternating current (AC) component, as well as the charging roller 12H, to transfer the foil transferring layer formed on the photoreceptor 11H onto the base material P. A specific example of a bias voltage impressed to the transfer roller 13H includes a superimposed voltage of a DC bias of ±500 to 1,000V which is a direct current component, and an AC bias of 100 Hz to 10 kHz and 200 to 3,500V which is an alternating current component, similarly to the specific example of a bias voltage impressed to the charging roller 12H.

The charging roller 12H and the transfer roller 13H may be driven by the photoreceptor 11H while being pressed onto the photoreceptor or may be driven by themselves. The pressing force of these rollers to the photoreceptor drum 11H is, for example, $9.8\times10^{-2}$ to $9.8\times10^{-1}$ N/cm. A rotational speed of the roller is, for example, circumferential speed 1 to 8 times of the photoreceptor 11H. The above pressing force of the rollers onto the photoreceptor 11H can be obtained, for example, by applying a force of 1 N to 10 N to the ends of the charging roller 12H.

The residual toner on the photoreceptor 11H after transferring the foil transferring layer to the base material P is removed by the cleaning blade 25*b* provided in the cleaning device 25 to be ready for performing the next foil transferring layer formation.

Further, it is also possible to transfer a foil having an image on a base material having thereon a foil transferring layer and further form a visible image on the base material. Examples of forming a visible image include image forming methods, such as an electrophotographic method, a printing method, an ink jet method and a conventional silver-salt photographic method. For example, after forming a foil transferring layer on a base material and transferring a foil on the foil transferring layer, a toner image can be formed via an electrophotographic method around the transferred foil. Or, it is also possible to form an image having a different type of hue by providing a color toner on the foil. According to these methods, a further luminosity expression can be given to a product having a transferred foil.

FIG. 3 is a cross-sectional configuration diagram of a foil transferring layer forming device.

Figure 4:
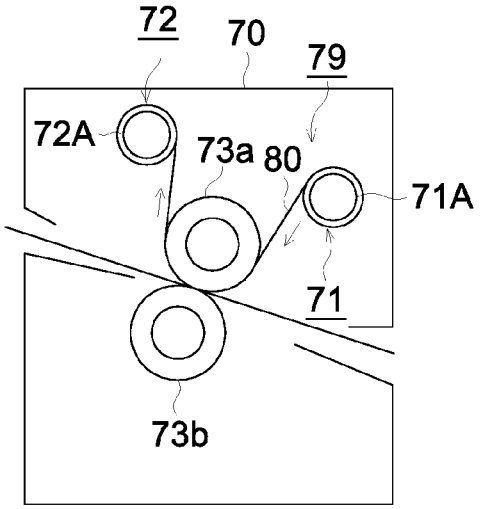
FIG. 4 is a schematic diagram of a transfer foil supplying portion of an apparatus for foil transferring and an arrangement of a foil transferring portion.

The image forming device includes a foil transferring layer toner image forming unit 20H, color toner image forming units 20Y, 20M, 20C and 20Bk forming a yellow, magenta, cyan or black toner image, respectively, intermediate transfer unit 10 transferring foil transferring layer toner image forming unit 20H or toner images formed on the color toner image forming unit 20Y, 20M, 20C and 20Bk on base material P (image support material), fixing device 50 fixing toner images by heating and applying pressure to base material P (image support material), and apparatus for foil transferring 70 supplying a transfer foil 80 to base material P (image support material), (see, FIG. 4).

Yellow toner image is formed in color toner image forming unit 20Y, magenta toner image is formed in color toner image forming unit color toner image forming unit 20M, cyan toner image is formed in color toner image forming unit 20C, and black toner image is formed color toner image forming unit 20Bk.

Foil transferring layer toner image forming unit 20H includes photoreceptor 11H which is electrostatic latent image carrier, charging device 23H charging uniform potential on the surface of the a photoreceptor 11H, exposing unit 22H forming an electrostatic latent image of desirable shape on a photoreceptor 11H charged uniformly, developing unit 21H supplying a toner for forming a foil transferring layer to photoreceptor 11H and visualizing the electrostatic latent image, and cleaning unit 25H recovering residual toner remained on photoreceptor 11H after first step transferring.

Color toner image forming unit 20Y, 20M, 20C and 20Bk include, photoreceptor 11Y, 11M, 11C and 11Bk which are electrostatic latent image carriers, charging devices 23Y, 23M, 23C and 23Bk charging uniform potential on the surface of the photoreceptors 11Y, 11M, 11C and 11Bk, exposing units 22Y, 22M, 22C and 22Bk forming electrostatic latent image of desirable shape on photoreceptors 11Y, 11M, 11C and 11Bk charged uniformly, developing units 21Y, 21M, 21C and 21Bk supplying a color toner to photoreceptors 11Y, 11M, 11C and 11Bk and visualizing the electrostatic latent images, and cleaning units 25Y, 25M, 25C and 25Bk recovering residual toner remained on photoreceptors 11Y, 11M, 11C and 11Bk after first step transferring.

Intermediate transfer unit 10 includes intermediate transfer member 16; first step transfer roller 13H transferring toner for forming a foil transferring layer image formed by foil transferring layer toner image forming unit 20H to intermediate transfer member 16; first step transfer rollers 13Y, 13M, 13C and 13Bk transferring color toner images formed by color toner image forming units 20Y, 20M, 20C and 20Bk to intermediate transfer member 16; second step transfer roller 13A transferring toner for forming a foil transferring layer image transferred on intermediate transfer member 16 by first step transfer roller 13H or transferring visualized toner images which are transferred on intermediate transfer member 16 by first step transfer rollers 13Y, 13M, 13C and 13Bk on base material P (image support material) on which foil image is formed; and cleaning unit 12 recovering residual toner remained on intermediate transfer member.

Intermediate transfer member 16 is an endless belt wound by plural supporting rollers 16*a* to 16*d* and circulatably supported.

Fixing device 50 includes a pair of heat-pressure rollers 51 and 52 mutually contact with pressured, and nip portion N is formed between the rollers.

Apparatus for foil transferring 70 includes foil transfer roller 73*a* rotating clockwise direction driven by an adequate driving device and foil transfer roller 73*b* rotating driven by foil transfer roller 73*a*, which press long sheet-shape transfer foil 80 onto base material P (image support material) to supply a foil, and conveying device 79 conveying transfer foil 80, as shown in FIG. 4.

In apparatus for foil transferring 70, a separation mechanism (not shown in drawing) is provided to change foil transfer rollers 73*a* and 73*b* into separated state mutually. The separation mechanism change foil transfer rollers 73*a* and 73*b* into separated state, when base material P (image support material) having the foil image and visual image brought out from fixing device 50 passes through apparatus for foil transferring 70 in case that a toner image is formed after forming a foil image.

Conveying device 79 conveying transfer foil 80 includes supplier 71 having take-out roller 71A on which transfer foil 80 is wound and reverse tension is applied to prevent transfer foil 80 from loosing, and winder 72 having winding roller 72A rotating in anti-clockwise direction (arrow direction in FIG. 4) by a driving source, and these are arranges so that conveying direction of transfer foil 80 is same as the moving direction of surface of foil transfer roller 73*a*.

A rotational speed of winding roller 72A in conveying device 79 is arranged so that conveying speed of transfer foil 80 at pressured contact portion between foil transfer roller 73*a* and 73*b* becomes same conveying speed of base material P (image support material) at the pressured contact portion.

Heat source (not shown in drawing) is provided with foil transfer rollers 73*a* and 73*b*, respectively.

A transfer foil applicable to this invention is described. The transfer foil F which can be used in the present invention has at least a film-like support f0 composed of, for example, a resin, a foil layer f2 containing a colorant or a metal, and an adhesive layer f1 containing an organic material which exhibits an adhesive property, and the foil layer f2 and the adhesive layer f1 transfer onto the base material P.

The support f0 is a film or a sheet which is composed of, for example, a resin. As a material of the support f0, well-known resin materials, for example, a polyethylene terephthalate (PET) resin, a polyethylenenaphthalate (PEN) resin, a polypropylene (PP) resin, a polyether sulfone resin and a polyimide resin may be cited. Further, it is also possible to use materials such as paper other than these resin materials.

The support f0 may either have a single layer structure or a multi-layer structure. When a multi-layer structure is adopted in the support f0, it is preferable that the support f0 has a release layer, which can be used for adjusting peel resistance, on the outermost surface of the support f0 facing the foil layer f2. Examples of a material for the release layer include: a thermo-curable resin employing melamine or isocyanate as a hardener; and a UV curable resin or an electron beam curable resin containing an acrylic resin or an epoxy resin, which is added with a releasing agent. Releasing agent to add to the releasing layer include a monomer or polymer of fluorine or silicone compound.

The foil layer f2 contains a colorant or a metallic material, and, after it is transferred onto a base material P, the foil layer f2 provides an aesthetic appearance. The foil layer f2 is expected to be smoothly released form the support f0 when it is transferred onto the base material P, while the foil layer f2 is expected, after transferred, to exhibit durability since it forms the outermost surface of the base material P. The foil layer f2 can be formed by applying a well-known resin which meets the above properties on the support f0 using a coater, for example, a gravure coater, a micro-gravure coater or a roll coater. Examples of such a well-known resin include an acrylic resin, a styrene resin and a melamine resin. It is also possible to add a dye or pigment into the resin to provide a color.

When a foil of a finish exhibiting metallic gloss is formed, it is possible to provide the resin with a reflecting layer formed according to a well-known method using, for example, a metal. Examples of a metallic material which forms a reflecting layer include carriers such as aluminum, tin, silver, chromium, nickel and gold. Alloys, for example, a nickel chromium iron alloy, bronze and aluminum bronze are also usable in addition to the above metal carries. Examples of a method to form a reflecting layer using the above metallic materials include well-known methods such as a vacuum evaporation method, a sputtering method and an ion plating method, by which it is possible to form a reflecting layer having a thickness of 10 nm to 100 nm. It is also possible to conduct a patterning process to provide a regular pattern using a well-known processing method, such as washing celite processing, etching processing, and laser beam machining, for example, to a reflecting layer.

The adhesive layer f1 contains a thermo sensitive adhesive agent so called a hot melt adhesive agent, which exhibits an adhesive property when heated. Examples of a thermo sensitive adhesive agent include thermoplastic resins usable for a hot melt adhesive agent such as an acrylic resin, a polyester based resin, a vinyl chloride-vinyl acetate copolymer, an epoxy resin and an ethylene-vinyl alcohol copolymer. The vinyl based resin such as acryl resin is preferable in view of affinity with a resin of the toner for forming foil transferring layer and The adhesive layer f1 can be formed by applying an aforementioned resin on a foil layer f2 using a coater, for example, a gravure coater, a micro-gravure coater or a roll coater.

EXAMPLE

The present invention is described in terms of examples.

Manufacturing Method of Toner

Preparation of Composite Resin SE-1

Components of a styrene acryl resin composition, n-octyl mercaptan (NOM) as a chain transfer agent, acrylic acid (AA) as a dual reaction property monomer and potassium persulfate (KPS) as a radical polymerization initiator shown in Table 1 were charged in a dripping funnel. Components of polyester based resin composition shown in Table 1 were charged in a reaction vessel equipped with a stirring device, a thermo-sensor, a condenser tube, a nitrogen inlet device and tempera was raised to 170° C., components of a styrene acryl resin composition was dripped through the dripping funnel while stirring, and then ripening was conducted for one hour. Subsequently, tin octoate as condensation polymerization catalyst was added and temperature was raised to 235° C., reaction was conducted for 8 hours at normal pressure (101.3 kPa), and reaction was continued at reduced pressure (20 kPa) so as to reaching to targeted softening point. Thus Composite Resin SE-1 was obtained.

Composite resins SE-2 and SE-3 were obtained by the same method as Composite Resin SE-1 except that amount of the materials were modified described in Table 1.

Preparation of Composite Resin Particles Dispersion A1

In 2,000 parts by weight of ethyl acetate (manufactured by Kanto Chemical Co., Inc.) 500 parts by weight of obtained Composite Resin SE-1 was dissolved, which was mixed with 3,200 parts by weight of preliminarily prepared dodecyl sodium sulfate solution having 0.26% by weight concentration, and was dispersed by a supersonic homogenizer (US-150T: product by Nihonseiki Kaisha LTD.) with V-LEVEL 300 μA for 2 hours while stirring, and subsequently and ethyl acetate was removed perfectly by stirring for 3 hours under reduced pressure at a temperature of 40° C. employing a diaphragm vacuum pump (V-700: product by BUCHI LABORTECHNIL AG). Thus Composite Resin Particles Dispersion A1 having an average particle diameter (volume average median particle diameter ($D_{50}$)) of 210 nm.

Composite Resin Particles Dispersion A2 and A3 were obtained in the same way as Composite Resin Particles Dispersion A1, except that Composite Resins SE-2 and SE-3 were used in place of Composite Resin SE-1, respectively.

TABLE 1

| | | | | Composite resin particles dispersion | | |
|---|---|---|---|---|---|---|
| | | | | A1 | A2 | A3 |
| | | | | Composite Resin No. | | |
| | | | | SE-1 | SE-2 | SE-3 |
| Components | Components of styrene-acryl resin composition | Styrene | (parts by weight) | 214 | 163 | 83 |
| | | Butyl acrylate | (parts by weight) | 80 | 60 | 30 |
| | | Methacrylic acid | (parts by weight) | 26 | 17 | 7 |
| | Chain transfer agent | n-Octyl mercaptan | (parts by weight) | 0.02 | 0.02 | 0.01 |
| | Dual reaction monomer | Acrylic acid | (parts by weight) | 6 | 6 | 6 |
| | Radical polymerization initiator | Potassium persulfate | (parts by weight) | 0.6 | 0.6 | 0.5 |
| | Components of polyester based resin composition | BPA-PO | (parts by weight) | 6 | 4 | 21 |
| | | BPA-EO | (parts by weight) | 49 | 37 | 172 |
| | | Terephthalic acid | (parts by weight) | 25 | 19 | 87 |
| | Polycondensation catalyst | Tin octoate | (parts by weight) | 0.5 | 0.3 | 0.5 |
| | Styrene-acryl/Polyester ratio | | | 80/20 | 60/40 | 30/70 |

BPA-PO: Propylene oxide adduct of bisphenol A

BPA-EO: Ethylene oxide adduct of bisphenol A

Preparation of Styrene Acryl Resin Particles Dispersion B1

First Step Polymerization

Solution in which 1.0 parts by weight of sodium polyoxy ethylene 2-dodecylether sulfate was dissolved in 1,125 parts by weight ion-exchanged water was charged in a reaction vessel equipped with a stirring device, a thereto-sensor, a condenser tube, a nitrogen inlet device, was heated up to 82° C., then a polymerizable monomer solution in which 130 parts by weight of styrene, 48 parts by weight of n-butyl acrylate, 12 parts by weight of methacrylic acid, 0.5 parts by weight of n-octyl mercaptan, 39 parts by weight microcrystalline wax (HNP-0190: manufactured by Nippon Seiro Co., Ltd.) were dissolved at 80° C., was added, then they were mixed and dispersed for 10 minutes via a mechanical type dispersion device having a circulation pass (CREARMIX: product by M Technique Co., Ltd.), and dispersion containing emulsified particles (oil droplets) was prepared.

Subsequently, initiator solution in which 7 parts by weight of potassium persulfate was dissolved in 125 parts by weight of ion-exchanged water was added to the dispersion, polymerization was conducted by stirring with heating at 82° C. for one hour, and resin particles dispersion was prepared.

Second Step Polymerization

To the above described resin particles dispersion solution in which 11 parts by weight of potassium persulfate was dissolved in 212 parts by weight of ion-exchanged water, then a polymerizable monomer solution composed of 406 parts by weight of styrene, 148 parts by weight of n-butyl acrylate, 48 parts by weight of methacrylic acid and 14 parts by weight of n-octyl mercaptan was dripped for one hour at temperature condition of 82° C.

After completion of dripping, polymerization was conducted by stirring with heating for one hour, and Styrene Acryl Resin Particles Dispersion B1 was obtained by cooling to 28° C.

Preparation of Amorphous Polyester Resin Particles Dispersion C1

Preparation Amorphous Polyester Resin C1

Into a reaction vessel equipped with a stirring device, a thermo-sensor, a condenser tube and a nitrogen inlet device, 316 parts by weight of bisphenol A propylene oxide 2 mol adduct, 138 parts by weight of terephthalic acid and condensation polymerization 2 parts by weight of titanium isopropoxide as a catalyst were divided into ten parts and added. Reaction was conducted for 10 hours at 200° C. while removing generated water by distillation in nitrogen stream. Subsequently reaction was conducted at reduced pressure pf 13.3 kPa (100 mmHg), and reaction was terminated when a volume average molecular-weight reached 15,000, and thus Amorphous Polyester Resin C1 was prepared.

In 400 parts by weight of ethyl acetate (manufactured by Kanto Chemical Co., Inc.) 200 parts by weight of thus obtained Amorphous Polyester Resin C1 was dissolved, which was mixed with preliminarily prepared 638 parts by weight of dodecyl sodium sulfate solution having 0.26% by weight concentration, and was dispersed by a supersonic homogenizer (US-150T: product by Nihonseiki Kaisha LTD.) with V-LEVEL 300 μA for 2 hours while stirring, and subsequently ethyl acetate was removed perfectly by stirring for 3 hours under reduced pressure at a temperature of 40° C. employing a diaphragm vacuum pump (V-700: product by BUCHI LABORTECHNIL AG). The Amorphous Polyester Resin particles Dispersion C1 having average particle diameter (volume average median particle diameter ($D_{50}$)) of 180 nm.

Preparation of Crystalline Polyester Resin Particles Dispersion C2

Preparation of Crystalline Polyester Resin C2

Into a reaction vessel equipped with a stirring device, a thermo-sensor, a condenser tube and a nitrogen inlet device, 176 parts by weight of sebacic acid, 103 parts by weight of 1,6-hexane diol and 2 parts by weight of titanium isopropoxide as a condensation polymerization catalyst was added as divided to 10 parts. Reaction was conducted for 10 hours at 200° C. while removing generated water by distillation in nitrogen stream. Subsequently reaction was conducted at reduced pressure pf 13.3 kPa (100 mmHg), and reaction was terminated when a volume average molecular-weight reached 15,000, and thus, Crystalline Polyester Resin C2 was prepared.

In 400 parts by weight of ethyl acetate (manufactured by Kanto Chemical Co., Inc.) 200 parts by weight of thus obtained Crystalline Polyester Resin C2 was dissolved, which was mixed with preliminarily prepared 638 parts by weight of dodecyl sodium sulfate solution having 0.26% by weight concentration, and was dispersed by a supersonic homogenizer (US-150T: product by Nihonseiki Kaisha LTD.) with V-LEVEL 300 μA for 2 hours while stirring, and subsequently ethyl acetate was removed perfectly by stirring for 3 hours under reduced pressure at a temperature of 40° C. employing a diaphragm vacuum pump (V-700: product by BUCHI LABORTECHNIL AG). Thus Crystalline Polyester Resin Particles Dispersion C2 having average particle diameter (volume average median particle diameter ($D_{50}$)) of 190 nm was obtained.

Preparation of Amorphous Polyester Resin C3

Into a reaction tank equipped with a condenser tube, a stirring device and a nitrogen inlet pipe, 316 parts by weight of bisphenol A propylene oxide 2 mol adduct, 80 parts by weight of terephthalic acid, 34 parts by weight of maleic anhydride and 2 parts by weight of titanium isopropoxide and a condensation polymerization catalyst were added as divided to 10 parts. Reaction was conducted for 10 hours at 200° C. while removing generated water by distillation in nitrogen stream. Subsequently reaction was conducted at reduced pressure pf 13.3 kPa (100 mmHg), and reaction was terminated when a softening point reached 104° C., and thus Amorphous Polyester Resin C3 was prepared. Amorphous Polyester Resin C3 had Tg of 65° C., number average molecular-weight of 4,500 and a volume average molecular-weight of 13,500.

Preparation of Styrene-Acryl Graft Modified Polyester Resin D1

In an autoclave reaction tank equipped with a thermometer and a stirring device 430 parts by weight of xylene and 430 parts by weight of Amorphous Polyester Resin C3 were charged and dissolved. After substitution by nitrogen gas, mixture solution of 86.0 parts by weight of styrene, 21.5 parts by weight of 2-ethylhexyl acrylate, 0.16 parts by weight of di-t-butylperoxide and 100 parts by weight of xylene was dripped and polymerization was conducted at 170° C. for 3 hours, and further allowed to maintain at this temperature for 30 minutes. Subsequently, solvent was removed and Styrene-Acryl Graft Modified Polyester Resin D1 was obtained Preparation of Styrene-Acryl Graft Modified Polyester Resin Particles Dispersion D1

Thus obtained Styrene-Acryl Graft Modified Polyester Resin D1 in an amount of 100 parts by weight was dissolved in 400 parts by weight of ethyl acetate (manufactured by Kanto Chemical Co., Inc.), which was mixed with 638 parts by weight of preliminarily prepared dodecyl sodium sulfate solution having 0.26% by weight concentration, and was dispersed by a supersonic homogenizer (US-150T: product by Nihonseiki Kaisha LTD.) with V-LEVEL 300 μA for 2 hours while stirring, and subsequently and ethyl acetate was removed perfectly by stirring for 3 hours under reduced pressure at a temperature of 40° C. employing a diaphragm vacuum pump (V-700: product by BUCHI LABORTECHNIL AG). Styrene-Acryl Graft Modified Polyester Resin Particles Dispersion D1 of solid substance 13.5% by weight having average particle diameter (volume based median particle diameter (D50)) of 160 nm was obtained.

Preparation of Releasing Agent Dispersion F1

Hundred parts by weight of microcrystalline wax (manufactured by HNP-0190, Nippon Seiro Co., Ltd.), 23 parts by weight of anionic surfactant (NEOGEN RK, manufactured by Dai-Ichi Kogyo Seiyaku Co., Ltd.) and 860 parts by weight of ion-exchanged water were mixed and heated to 110° C., then were dispersed by a homogenizer (UL IRA TURRAX T50, manufactured by IKA Werke GmbH & Co. KG), then they were subjected to dispersion treatment via MANTON GAULIN high pressure homogenizer (manufactured by Manton Gaulin). Thus Releasing Agent Dispersion Of Microparticles F-1 was obtained. An average particle diameter (volume average median particle diameter ($D_{50}$)) of the releasing agent microparticles in the obtained dispersion was 250 nm.

Preparation of Toner Particles 1

In a reaction vessel equipped with a stirring device, a thermo-sensor, a condenser tube and a nitrogen inlet device, 450 parts by weight (solid substance conversion) of Composite Resin Particles Dispersion A1, 3 parts by weight (solid substance conversion) of Releasing Agent Dispersion F1, 2 parts by weight of sodium polyoxy ethylene 2-dodecylether sulfate and 900 parts by weight of ion-exchanged water were charged, temperature was adjusted to 25° C., then pH was adjusted to 10 by adding sodium hydroxide aqueous solution of 25% by weight.

Subsequently, aqueous solution in which 70 parts by weight of magnesium chloride was dissolved in 105 parts by weight of ion-exchanged water was added taking 30 minutes at 30° C., while stirring, after keeping 3 minutes, temperature was started to raise, this system was raised to 80° C. taking 60 minutes, and particle size growing reaction was continued keeping 80° C.

In this state, particle diameter of coagulation particles was measured via Coulter Multisizer 3, and particle size growing was terminated by adding aqueous solution in which 75 parts by weight of sodium chloride was dissolved 290 parts by weight of ion-exchanged water when particle diameter Dv50 reached to 6.5 μm.

Further, fusion of particles was progressed until average circularity measured by FPIA-2100 reached to 0.960 by heating and stirring at liquid temperature 88° C. as a ripening process, and toner particles were formed. Subsequently, liquid temperature was cooled to 30° C., pH was adjusted to 2.0 by adding hydrochloric acid and stirring was terminated.

The toner particles obtained by the above described process were subjected to solid-liquid separation via a basket type centrifugal separator, MARKIII Type 60×40 (manufactured by Matsumoto Machine MFG. Co., Ltd.), to form a wet cake of the toner particles. The wet cake was washed with ion-exchanged water at 45° C. using a basket type centrifugal separator until electric conductivity of filtrate became 5 μS/cm. Subsequently, it was dried via a flash jet dryer (manufactured by Seishin Enterprise Co., Ltd.) so that water content became 1.0% by weight, and Toner Particles 1 was obtained.

Preparation of Toner Particles 2

Toner Particles 2 was obtained by the same way as Preparation of Toner Particles 1, except that Composite Resin Particles Dispersion A1 in Preparation of Toner Particles 1 was replaced with Composite Resin Particles Dispersion A2 and amount of Releasing Agent Dispersion F1 was 8 parts by weight (solid substance conversion).

Preparation of Toner Particles 3

Toner Particles 3 was obtained by the same way as Preparation of Toner Particles 1, except that Composite Resin Particles Dispersion A1 in Preparation of Toner Particles 1 was replaced with 423 parts by weight (solid substance conversion) of Styrene Acryl Resin Particles Dispersion B1 and 27 parts by weight (solid substance conversion) of Amorphous Polyester Resin Particles Dispersion C1 and Releasing Agent Dispersion F1 was not added.

Preparation of Toner Particles 4

Toner Particles 4 was obtained by the same way as Preparation of Toner Particles 1, except that Composite Resin Particles Dispersion A1 in Preparation of Toner Particles 1 was replaced with 400 parts by weight (solid substance conversion) of Styrene Acryl Resin Particles Dispersion B1 and 50 parts by weight (solid substance conversion) of Amorphous Polyester Resin particles dispersion C1 and Releasing Agent Dispersion F1 was not added.

Preparation of Toner Particles 5

Toner Particles 5 was obtained by the same way as Preparation of Toner Particles 1, except that Composite Resin Particles Dispersion A1 in Preparation of Toner Particles 1 was replaced with 360 parts by weight (solid substance conversion) of Styrene Acryl Resin Particles Dispersion B1 and 90 parts by weight (solid substance conversion) of Amorphous Polyester Resin particles dispersion C1 and amount of Releasing Agent Dispersion F1 was changes to 4 parts by weight (solid substance conversion).

Preparation of Toner Particles 6

Toner Particles 6 was obtained by the same way as Preparation of Toner Particles 1, except that Composite Resin Particles Dispersion A1 in Preparation of Toner Particles 1 was replaced with 230 parts by weight (solid substance conversion) of Styrene Acryl Resin Particles Dispersion B1 and 220 parts by weight (solid substance conversion) of Amorphous Polyester Resin particles dispersion C1 and amount of Releasing Agent Dispersion F1 was changed to 10 parts by weight (solid substance conversion).

Preparation of Toner Particles 7

Toner Particles 7 was obtained by the same way as Preparation of Toner Particles 1, except that Composite Resin Particles Dispersion A1 in Preparation of Toner Particles 1 was replaced with 360 parts by weight (solid substance conversion) of Styrene Acryl Resin Particles Dispersion B1 and 126 parts by weight (solid substance conversion) of Crystalline Polyester Resin Particles Dispersion C2 and amount of Releasing Agent Dispersion F1 was changed to 4 parts by weight (solid substance conversion).

Preparation of Toner Particles 8

Toner Particles 8 was obtained by the same way as Preparation of Toner Particles 1, except that Composite Resin Particles Dispersion A1 in Preparation of Toner Particles 1 was replaced with 416.2 parts by weight (solid substance conversion) of Styrene Acryl Resin Particles Dispersion B1 and 33.8 parts by weight (solid substance conversion) of Styrene-Acryl Graft Modified Polyester Resin Particles Dispersion D1 and Releasing Agent Dispersion F1 was not added.

Preparation of Toner Particles 9

Toner Particles 9 was obtained by the same way as Preparation of Toner Particles 1, except that Composite Resin Particles Dispersion A1 in Preparation of Toner Particles 1 was replaced with 387.5 parts by weight (solid substance conversion) of Styrene Acryl Resin Particles Dispersion B1 and 62.5 parts by weight (solid substance conversion) of Styrene-Acryl Graft Modified Polyester Resin Particles Dispersion D1 and amount of Releasing Agent Dispersion F1 was changed to 3 parts by weight (solid substance conversion).

Preparation of Toner Particles 10

Toner Particles 10 was obtained by the same way as Preparation of Toner Particles 1, except that Composite Resin Particles Dispersion A1 in Preparation of Toner Particles 1 was replaced with 337.5 parts by weight (solid substance conversion) of Styrene Acryl Resin Particles Dispersion B1 and 112.5 parts by weight (solid substance conversion) of Styrene-Acryl Graft Modified Polyester Resin Particles Dispersion D1 and amount of Releasing Agent Dispersion F1 was changed to 5 parts by weight (solid substance conversion).

Preparation of Toner Particles 11

Toner Particles 11 was obtained by the same way as Preparation of Toner Particles 1, except that Composite Resin Particles Dispersion A1 in Preparation of Toner Particles 1 was replaced with 175 parts by weight (solid substance conversion) of Styrene Acryl Resin Particles Dispersion B1 and 275 parts by weight (solid substance conversion) of Styrene-Acryl Graft Modified Polyester Resin Particles Dispersion D1 and amount of Releasing Agent Dispersion F1 was changed to 12 parts by weight (solid substance conversion).

Preparation of Toner Particles 12

Toner Particles 12 was obtained by the same way as Preparation of Toner Particles 1, except that Composite Resin Particles Dispersion A1 in Preparation of Toner Particles 1 was replaced with Composite Resin Particles Dispersion A3 and amount of Releasing Agent Dispersion F1 was changed to 14 parts by weight (solid substance conversion).

Preparation of Toner Particles 13

Toner Particles 13 was obtained by the same way as Preparation of Toner Particles 1, except that Composite Resin Particles Dispersion A1 in Preparation of Toner Particles 1 was replaced with 437 parts by weight (solid substance conversion) of Styrene Acryl Resin Particles Dispersion B1 and 14 parts by weight (solid substance conversion) of Amorphous Polyester Resin Particles Dispersion C1 and Releasing Agent Dispersion F1 was not added.

Preparation of Toner Particles 14

Toner Particles 14 was obtained by the same way as Preparation of Toner Particles 1, except that Composite Resin Particles Dispersion A1 in Preparation of Toner Particles 1 was replaced with Styrene Acryl Resin Particles Dispersion B1 and Releasing Agent Dispersion F1 was not added.

Preparation of Toner for Forming a Foil Transferring Layers 1 to 14

External Additive Treatment

Toner for Forming Foil Transferring Layer 1 was prepared by adding external additive described below to 100 parts by weight of Toner Particles 1, prepared as described above, and subjecting an external additive treatment via Henschel mixer (manufactured by Mitsui Mike Mining Co., Ltd.).

| | |
|---|---|
| Hexamethylsilazane-treated Silica (average primary particle diameter: 12 nm) | 1.0 part by weight |
| n-Octylsilane-treated titanium dioxide (average primary particle diameter: 20 nm) | 0.3 parts by weight |

The treatment by Henschel mixer was carried out for 15 minutes at a circumference speed of the stirring wing of 35 msec and a treatment temperature of 35° C.

Toners for Forming Foil Transferring Layers 2 to 14 were prepared by similar way using Toner Particles 1 to 14. Each toner particle diameter was 6.4 μm in terms of volume based median particle diameter. Toners 12 to 14 were comparative samples.

Evaluation Method

Preparation of Developers 1 to 14

A ferrite carrier having an average particle diameter of 50 μm covered with a methylmethacrylate resin was mixed with each of toner for forming a foil transferring layers 1 to 14 so that the content of each toner is 6% by weight. Thus toner for forming a foil transferring layer developers 1 to 14 which were two-component developers were prepared, and the following evaluation was conducted.

(1) Evaluation Condition

Each of toner for forming a foil transferring layer developers 1 to 14 was charged in the toner for forming a foil transferring layer supplying member 21H of foil transferring layer forming device having the structure shown in FIG. 3, and a foil transferring layer was formed on a commercially available image carrier "OK TOP COAT+(basis weight of 157 g/m$^2$, thickness of 131 μm)" manufactured by OJI PAPER Co., Ltd., which was the base material of foil transferring. In foil transferring layer forming device, foil transferring layers were formed by setting the supplying amount of the toner for forming a foil transferring layer at 4 g/m$^2$.

The fixing speed of an image support material in fixing device 50 was set at 230 mm/sec, polytetrafluoroethylene (PTFE) was used as a surface material of the heating roll, and the surface temperature of the heating roll was set at 135° C.

After forming a foil transferring layer on an image support material with each toner using aforementioned foil transferring layer forming device, a foil was transferred on the foil transferring layer formed on each image support material using a commercially available transfer foil. The transfer foil used was "BL No. 2 gold 2.8" manufactured by MURATA-KIMPAKU Co., Ltd., which was composed of a PET (polyethylene terephthalate) substrate, a foil layer composed of an aluminum vapor deposited layer, and an adhesive layer containing an acryl resin and a polyester resin.

Foil transfer was carried out according to the procedure shown in FIGS. 1*a* to 1*e* under the following conditions, Heating roll: a silicone rubber layer of a thickness of 3 mm was provided on an aluminum substrate of outer diameter of 100 mm with a thickness of 10 mm, having a surface temperature of 150° C.;

Pressure roll: a silicone rubber layer of a thickness of 3 mm was provided on an aluminum substrate of outer diameter of 80 mm with a thickness of 10 mm, having a surface temperature of 100° C.;

Heat source: a halogen lamp was provided in each inside of the heating roller and the pressure roll (each temperature was controlled using a thermistor), Nip width between the heating roller and the pressure roll was 7 mm, Image support material conveying speed: 200 mm/sec, Image support material: feeding a A3 sized image support material along the longitudinal direction, and Evaluation ambient: normal temperature normal relative humidity ambient (temperature of 20° C. and 50% RH).

Figure 5A:
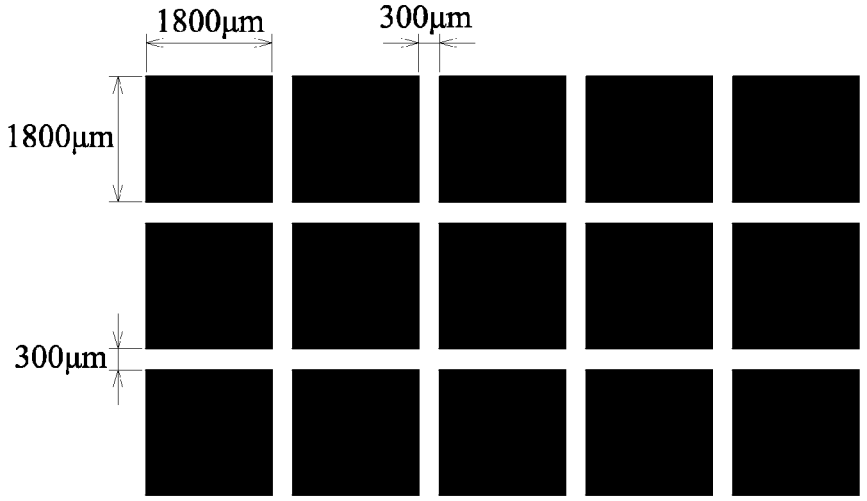
FIG. 5*a* is a foil image sample for evaluation of missing foil and FIG. 5*b* is a foil image sample for evaluation of a burr.
Figure 5B:
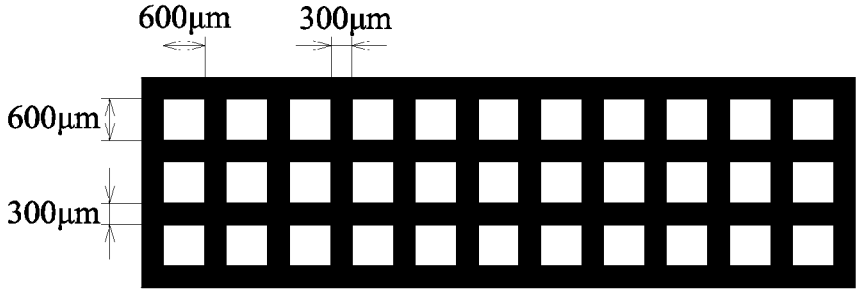

Under the above conditions, two kinds of foil image samples (a) and (b) shown in FIG. 5 were created on the image support material. A black portion of the drawing is an area on which a foil transferring layer is formed by developing with a toner for forming a foil transferring layer, and the foil image "a" in FIG. 5*a* was used evaluation of foil missing, and the foil image "b" in FIG. 5*b* was used evaluation of burr.

After evaluating missing of foil in the foil image thus obtained as described above, paper was allowed to pass through the at a image support material conveying speed 90 mm/sec.

(2) Evaluation Items

On each of the foils formed on the specimen according to the aforementioned procedure, evaluation was carried out with respect to each of missing of the foil on the foil transferring layer, occurrence of a burr. The evaluation of "missing of the foil on the foil transferring layer" was carried out to examine whether the adhesive strength of the foil transferring layer was too weak or not. The "occurrence of a burr" would be observed when there is adhesion unevenness at an edge portion of the image, and it would not be observed when the adhesion is strong enough.

Missing on Foil Transferring Layer

The foil image "a" formed on each specimen were observed visually and employing a magnifier having a magnifying power of 10 times and presence of missing of the foil image on the foil transferring layer was evaluated according to the following evaluation criteria. In the present invention, A, B and C were acceptable, while D was not acceptable.

A No missing of the foil image was observed even employing a magnifier,

B No problem was visually observed, however, one or two missing of the foil image was observed employing the magnifier, C No problem was visually observed, however, three or more missing of the foil image was observed employing the magnifier, and D Missing of the foil image was visually observed.

Occurrence of Burr

The foil image foil image "b" formed on each specimen were observed visually and employing a magnifier having a magnifying power of 10 times and occurrence of burr in the foil image on the foil transferring layer was evaluated according to the following evaluation criteria. In the present invention, A and B were acceptable, while C was not acceptable.

A No occurrence of burr in the foil image was observed even employing a magnifier, B No problem was visually observed, however, one or two occurrence of burr in the foil image was observed employing the magnifier, and C No problem was visually observed, however, three or more occurrence of burr in the foil image was observed employing the magnifier, D Occurrence of burr in the foil image was visually observed.

It is apparent the toner for forming a foil transferring layer according to the invention exhibited excellent advantage in foil missing and generation of a burr in comparison with comparative toner for forming a foil transferring layer as a result shown in Table 2.

The invention claimed is:

1. A foil transferring method comprising the steps of:

exposing a photoreceptor to form an electrostatic latent image;

supplying a foil transferring toner to the photoreceptor having thereon the electrostatic latent image to form a foil transferring layer on the photoreceptor;

transferring the foil transferring layer formed on the photoreceptor onto a base material;

fixing the foil transferring layer on the base material;

supplying a transfer foil having at least a foil and an adhesive layer to the base material having the fixed foil transferring layer; bringing the adhesive layer of the transfer foil in contact with the foil transferring layer;

heating the transfer foil and the foil transferring layer while the adhesive layer of the transfer foil is in contact with the foil transferring layer to adhere the foil onto the foil transferring layer; and removing the transfer foil from the base material while leaving the foil adhered onto the foil transferring layer, wherein the adhesive layer of the transfer foil comprises a thermoplastic resin, the foil transferring toner has a binder resin which comprises at least a vinyl based resin and a polyester based resin, and a content ratio of the vinyl based resin is 50 to 95% by weight based on the total amount of the binder resin.

2. The foil transferring method of claim 1, wherein the vinyl based resin is a styrene acryl resin.

3. The foil transferring method of claim 1, wherein the binder resin of the foil transferring toner is a resin bonding a vinyl based resin to a polyester based resin mutually.

4. The foil transferring method of claim 1, wherein the binder resin of the foil transferring toner is a composite resin bonding a vinyl based resin to a polyester based resin mutually.

5. The foil transferring method of claim 1, wherein the binder resin of the foil transferring toner comprises a mixture of two resins in which a first resin is a vinyl based resin and a second resin is a vinyl based resin bonded to a polyester based resin.

TABLE 2

| Toner No. | Resin particles dispersion 1 | Resin particles dispersion 2 | Styrene-acryl content ratio | Polyester content ratio | Foil missing on foil transferring layer | Burr of foil on foil transferring layer | Remarks |
|---|---|---|---|---|---|---|---|
| 1 | A1 | — | 80% | 20% | A | A | Invention |
| 2 | A2 | — | 60% | 40% | A | B | Invention |
| 3 | B1 | C1 | 94% | 6% | B | B | Invention |
| 4 | B1 | C1 | 89% | 11% | B | A | Invention |
| 5 | B1 | C1 | 80% | 20% | B | A | Invention |
| 6 | B1 | C1 | 51% | 49% | B | B | Invention |
| 7 | B1 | C2 | 80% | 20% | B | C | Invention |
| 8 | B1 | D1 | 94% | 6% | B | A | Invention |
| 9 | B1 | D1 | 89% | 11% | A | A | Invention |
| 10 | B1 | D1 | 80% | 20% | A | A | Invention |
| 11 | B1 | D1 | 51% | 49% | A | C | Invention |
| 12 | A3 | — | 30% | 70% | A | D | Comparative |
| 13 | B1 | C1 | 97% | 3% | D | B | Comparative |
| 14 | B1 | — | 100% | 0% | D | A | Comparative |

6. The foil transferring method of claim 5, wherein the second resin is contained in an amount of 80% by weight to 90% by weight based on the total weight of the binder resin.

* * * * *